US010578283B2

(12) United States Patent
Parker, II et al.

(10) Patent No.: US 10,578,283 B2
(45) Date of Patent: Mar. 3, 2020

(54) LIGHT LEAK SOLUTIONS FOR LINEAR LIGHT FIXTURES

(71) Applicant: Eaton Intelligent Power Limited, Dublin (IE)

(72) Inventors: Gregory Howard Parker, II, Denver, CO (US); Timothy Bingaman, Thornton, CO (US); Jason Medric Eubanks, Long Beach, NY (US); John Strom, Commerce City, CO (US); John Leon, Parker, CO (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/962,578

(22) Filed: Apr. 25, 2018

(65) Prior Publication Data

US 2019/0331322 A1 Oct. 31, 2019

(51) Int. Cl.

| | |
|---|---|
| ***F21V 5/04*** | (2006.01) |
| ***F21V 15/015*** | (2006.01) |
| ***F21V 17/10*** | (2006.01) |
| *F21Y 103/10* | (2016.01) |

(52) U.S. Cl.

CPC ..... *F21V 15/015* (2013.01); *F21V 5/04* (2013.01); *F21V 17/101* (2013.01); *F21Y 2103/10* (2016.08)

(58) Field of Classification Search

CPC ..... F21Y 2103/10; F21V 5/04
USPC ..... 362/222, 223
See application file for complete search history.

(56) References Cited

U.S. PATENT DOCUMENTS

| | | | | |
|---|---|---|---|---|
| 2006/0139952 | A1* | 6/2006 | Inoue | G02F 1/133603 362/613 |
| 2013/0027924 | A1* | 1/2013 | Shimizu | F21V 23/06 362/223 |
| 2015/0062890 | A1* | 3/2015 | Camarota | F21V 5/04 362/223 |
| 2015/0167902 | A1* | 6/2015 | Rodgers | F21S 8/03 362/221 |

OTHER PUBLICATIONS

Selux Lighting; M130 LED Recessed Compatible with 6" Technical Ceiling Systems; Oct. 2017.
Finelite: High Performance Perimeter Slot (HP-WS), Specification Sheet; Oct. 2017.

(Continued)

*Primary Examiner* — Julie A Bannan
(74) *Attorney, Agent, or Firm* — King & Spalding LLP

(57) ABSTRACT

A linear light fixture can include a housing that includes at least one wall that forms a cavity. The linear light fixture can also a light board having multiple light sources disposed thereon, where the light sources are arranged in a linear fashion with respect to each other on the light board, where the light board is disposed within the cavity of the housing. The linear light fixture can further include a lens slidably disposed within a receiving feature of the housing. The linear light fixture can also include a first auxiliary optical member disposed within cavity of the housing, where the first auxiliary optical member includes a first body having a first end and a second end, where the first body includes a light diffusion film. The first auxiliary optical member can fill a first gap between the lens and a first side wall of the housing.

16 Claims, 20 Drawing Sheets

(56) References Cited

OTHER PUBLICATIONS

Mark lighting; Slot 4 LED Recessed Linear Specification Sheet; Mar. 22, 2018.
Zumtobel Lighting; Slotlight II Brochure; Nov. 2014.
Pinnacle lighting; Edge Brochure Sep. 2013.
Prudential lighting; Bionic LED; Recessed Linear and Wall Wash 4" Slot; Jan. 24, 2018.

* cited by examiner

LIGHT LEAK SOLUTIONS FOR LINEAR LIGHT FIXTURES

TECHNICAL FIELD

The present disclosure relates generally to light fixtures, and more particularly to systems, methods, and devices for preventing light leakage in linear light fixtures.

BACKGROUND

Light fixtures are used in a variety of environments and have a number of configurations. For example, linear light fixtures have a number of light sources aligned in a linear fashion on a circuit board, and the circuit board is disposed within a housing of the light fixture. Continuing with this example, the circuit board is recessed relative to the opening in the housing through which light is emitted, and a lens is slotted into the opening. In such a case, the end of the lens is not long enough to fill the entire length of the opening in the housing, and a small gap between the housing and one or both ends of the lens results. This gap allows for light leakage that is inconsistent with the light emitted through the lens.

SUMMARY

In general, in one aspect, the disclosure relates to a linear light fixture that includes a housing having at least one wall that forms a cavity, where the at least one wall includes a top wall, a bottom wall opposite the top wall, a first side wall disposed between the top wall and the bottom wall, and a second side wall disposed between the top wall and the bottom wall and opposite the first side wall, where the top wall and the bottom wall have a receiving feature disposed at their distal end. The linear light fixture can also include a lighting assembly having a circuit board and multiple light sources disposed on the circuit board, where the light sources are arranged in a linear fashion with respect to each other on the circuit board, where the lighting assembly is disposed within the cavity of the housing toward a proximal end of the top wall, the bottom wall, the first side wall, and the second side wall. The linear light fixture can further include a lens slidably disposed within the receiving feature of the housing. The linear light fixture can also include a first auxiliary optical member disposed within the cavity of the housing, where the first auxiliary optical member includes a first body having a first end and a second end, where the first body includes a light diffusion film. The first auxiliary optical member can fill a first gap between the lens and the first side wall of the housing. The first portion of light emitted by the light sources passes through the light diffusion film of the first body of the first auxiliary optical member.

In another aspect, the disclosure can generally relate to an auxiliary optical member for a linear light fixture. The auxiliary optical member can include a body having a first end and a second end, wherein the body includes a light diffusion film. The body can be configured to be disposed within a housing of a light fixture adjacent to a lens of the linear light fixture, where the body is configured to allow a portion of light emitted by the plurality of light sources to pass through the light diffusion film.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
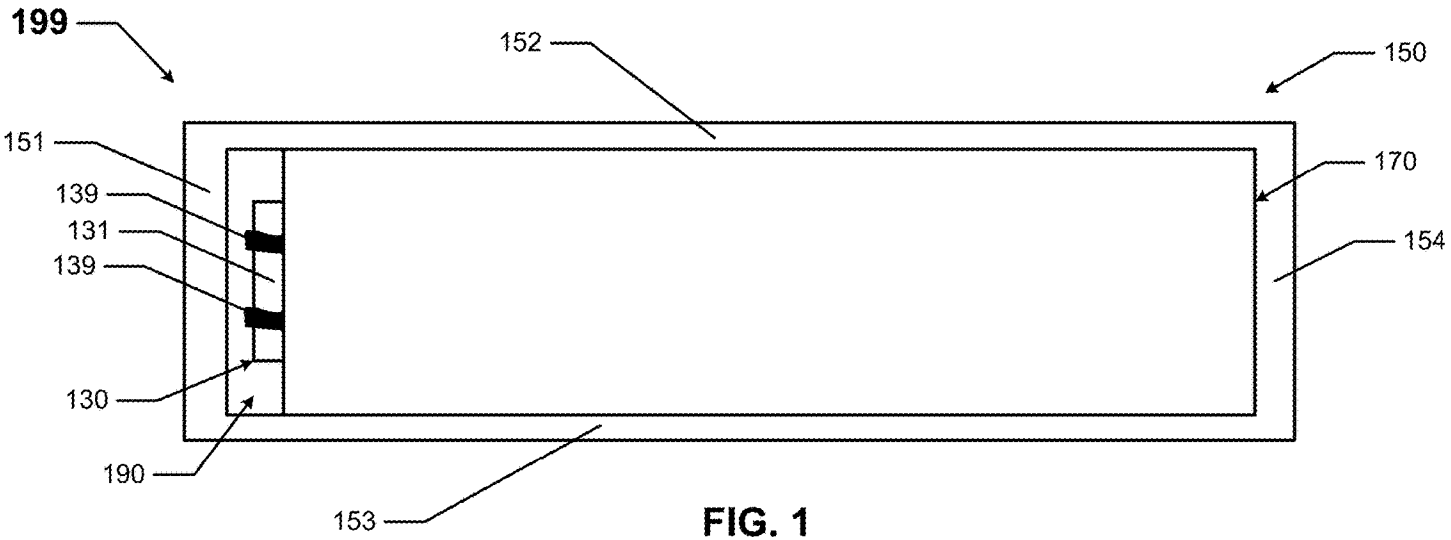
FIG. 1 (Prior Art)
FIG. 1 shows a linear light fixture currently used in the art.

In general, example embodiments provide systems, methods, and devices for light leak solutions for linear light fixtures. Example light leak solutions for linear light fixtures provide a number of benefits. Such benefits can include, but are not limited to, more uniform light distribution, better aesthetics, and compliance with applicable industry standards. While example light leak solutions are shown and described herein as being used with linear light fixtures, example light leak solutions can be used with any other type of light fixture. Further, example light leak solutions for linear light fixtures can be used with any type of lighting technology, including but not limited to light-emitting diode (LED), incandescent, sodium vapor, and fluorescent.

The linear light fixtures for which example light leak solutions can be used can be located in one or more of any of a number of environments (e.g., indoors, outdoors, office space). Example light leak solutions described herein can be used with new light fixtures or can be retrofit into existing light fixtures. A user may be any person that interacts with light fixtures. Examples of a user may include, but are not limited to, an engineer, an electrician, an operator, a consultant, a homeowner, a business owner, a landlord, a building manager, a contractor, and a manufacturer's representative.

The example light leak solutions (or components thereof, including controllers) described herein can be made of one or more of a number of suitable materials to allow the associated light fixture to meet certain standards and/or regulations while also maintaining durability in light of the one or more conditions under which the light fixtures and/or light leak solutions can be exposed. Examples of such materials can include, but are not limited to, fiberglass, glass, and plastic (e.g., mylar, polyester).

Example light leak solutions (or portions thereof) can be made from a single piece (as from a mold, injection mold, die cast, or extrusion process). In addition, or in the alternative, example light leak solutions (or portions thereof) can be made from multiple pieces that are mechanically coupled to each other. In such a case, the multiple pieces can be mechanically coupled to each other using one or more of a number of coupling methods, including but not limited to epoxy, adhesive, welding, fastening devices, compression fittings, mating threads, and slotted fittings. One or more pieces that are mechanically coupled to each other can be coupled to each other in one or more of a number of ways, including but not limited to fixedly, hingedly, movably, removeably, slidably, and threadably.

Components and/or features described herein can include elements that are described as coupling, fastening, securing, retaining, abutting against, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example light leak solution to become mechanically coupled, directly or indirectly, to a portion of a light fixture (or portion thereof, such as a housing or tray insert). A coupling feature can include, but is not limited to, a portion of a hinge, an aperture, a recessed area, a surface of a wall, a protrusion, a slot, a spring clip, a male connector end, a female connector end, a tab, a detent, and mating threads. One portion of an example light leak solution can be coupled to a portion of a light fixture by the direct use of one or more coupling features.

In addition, or in the alternative, a portion of an example light leak solution can be coupled to a portion of a light fixture using one or more independent devices that interact with one or more coupling features disposed on a component of the light leak solution. Examples of such devices can include, but are not limited to, a pin, a male connector end, a female connector end, a hinge, epoxy, welding, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing light leak solutions for linear light fixtures, one or more of the components shown may be omitted, repeated, and/or substituted. Accordingly, embodiments of light leak solutions for linear light fixtures should not be considered limited to the specific arrangements of components shown in any of the figures. For example, features shown in one or more figures or described with respect to one embodiment can be applied to another embodiment associated with a different figure or description.

In certain example embodiments, light fixtures having example light leak solutions are subject to meeting certain standards and/or requirements. For example, the National Electric Code (NEC), Underwriters Laboratories (UL), the National Electrical Manufacturers Association (NEMA), the International Electrotechnical Commission (IEC), the Illuminating Engineering Society (IES), and the Institute of Electrical and Electronics Engineers (IEEE) set standards as to light fixtures. Use of example embodiments described herein meet (and/or allow a corresponding device to meet) such standards when required.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three or four digit number and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of light leak solutions for linear light fixtures will be described more fully hereinafter with reference to the accompanying drawings, in which example embodiments of light leak solutions for linear light fixtures are shown. Light leak solutions for linear light fixtures may, however, be embodied in many different forms and should not be construed as limited to the example embodiments set forth herein. Rather, these example embodiments are provided so that this disclosure will be thorough and complete, and will fully convey the scope of light leak solutions for linear light fixtures to those of ordinary skill in the art. Like, but not necessarily the same, elements (also sometimes called components) in the various figures are denoted by like reference numerals for consistency.

Terms such as "first", "second", "top", "bottom", "front", "rear", "side", "end", "distal", "proximal", "left", "right", "outward", and "within" are used merely to distinguish one component (or part of a component or state of a component) from another. Such terms are not meant to denote a preference or a particular orientation, and are not meant to limit embodiments of light leak solutions for linear light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a linear light fixture 199 currently used in the art. In this case, the linear light fixture 199 includes a housing 150 and a lens 170 slidably disposed with respect to the housing 150. The housing has one or more walls (e.g., top wall 152, left side wall 151, right side wall 154, bottom wall 153), and one or more of these walls (in this case, top wall 152 and bottom wall 153) can include one or more coupling features (e.g., slots) used to slidably receive the lens 170. Such coupling features (hidden from view, but shown and described in more detail below) can be positioned toward the distal end of the walls of the housing 150.

Disposed within the housing 150 can be one or more components of the linear light fixture 199. For example, visible in this case, are a number of electrical conductors 139 attached to a circuit board 131 of a lighting assembly 130. The lighting assembly 130 can also include one or more of a number of other components mounted on the circuit board 131, including but not limited to a light source, a capacitor, a resistor, an integrated circuit, a diode, and an inductor.

In order to allow for removal of the lens 170 from the housing 150, which allows access to the lighting assembly 130 within the housing 150, the length of the lens 170 must be shorter than the length of the housing 150 (in this case, the distance between the left side wall 151 and the right side wall 154 of the housing 150). As a result, there are one or more (in this case, only one) gaps 190 between an end of the lens 170 and the housing 150. This gap 190 can make one or more components (in this case, the electrical conductors 139 and part of the circuit board 131) of the lighting assembly 130 to be visible to a user. The exposure of these components of the lighting assembly 130 are not aesthetically pleasing.

Figure 2:
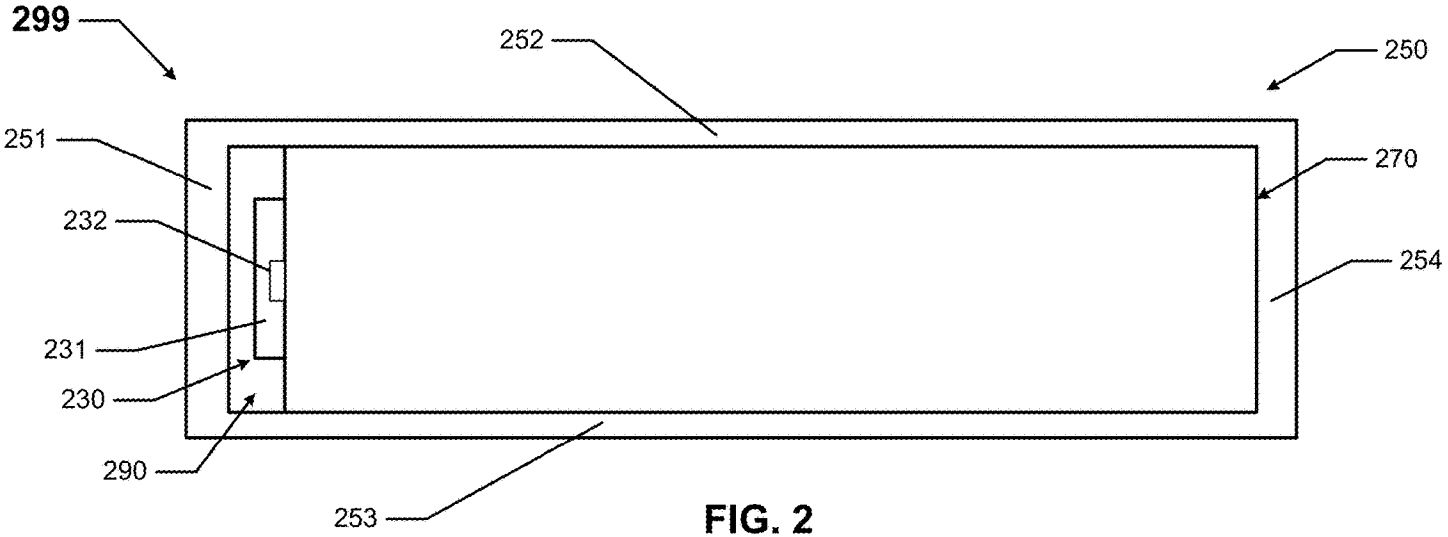
FIG. 2 (Prior Art)
FIG. 2 shows another linear light fixture currently used in the art.

FIG. 2 shows another linear light fixture 299 currently used in the art. Referring to FIGS. 1 and 2, similar to the linear light fixture 199 of FIG. 1, the linear light fixture 299 of FIG. 2 includes a housing 250 and a lens 270 slidably disposed with respect to the housing 250. The housing has one or more walls (e.g., top wall 252, left side wall 251, right side wall 254, bottom wall 253), and one or more of these walls (in this case, top wall 252 and bottom wall 253) can include one or more coupling features (e.g., slots) used to slidably receive the lens 270. Such coupling features (hidden from view, but shown and described in more detail below) can be positioned toward the distal end of the walls of the housing 250.

Disposed within the housing 250 can be one or more components of the linear light fixture 299. For example, visible in this case, are a light source 232 mounted on part of a circuit board 231 of a lighting assembly 230. Again, in order to allow for removal of the lens 270 from the housing 250, which allows access to the lighting assembly 230 within the housing 250, the length of the lens 270 is shorter than the length of the housing 250 (in this case, the distance between the left side wall 251 and the right side wall 254 of the housing 250). As a result, there are one or more (in this case, only one) gaps 290 between an end of the lens 270 and the housing 250. This gap 290 can make one or more components (in this case, a light source 232 and part of the circuit board 231) of the lighting assembly 230 to be visible to a user. The exposure of these components of the lighting assembly 130 are not aesthetically pleasing, and the light emitted by the visible light source 232 can drastically and negatively alter the designed light distribution of the linear light fixture 299.

Figure 3:
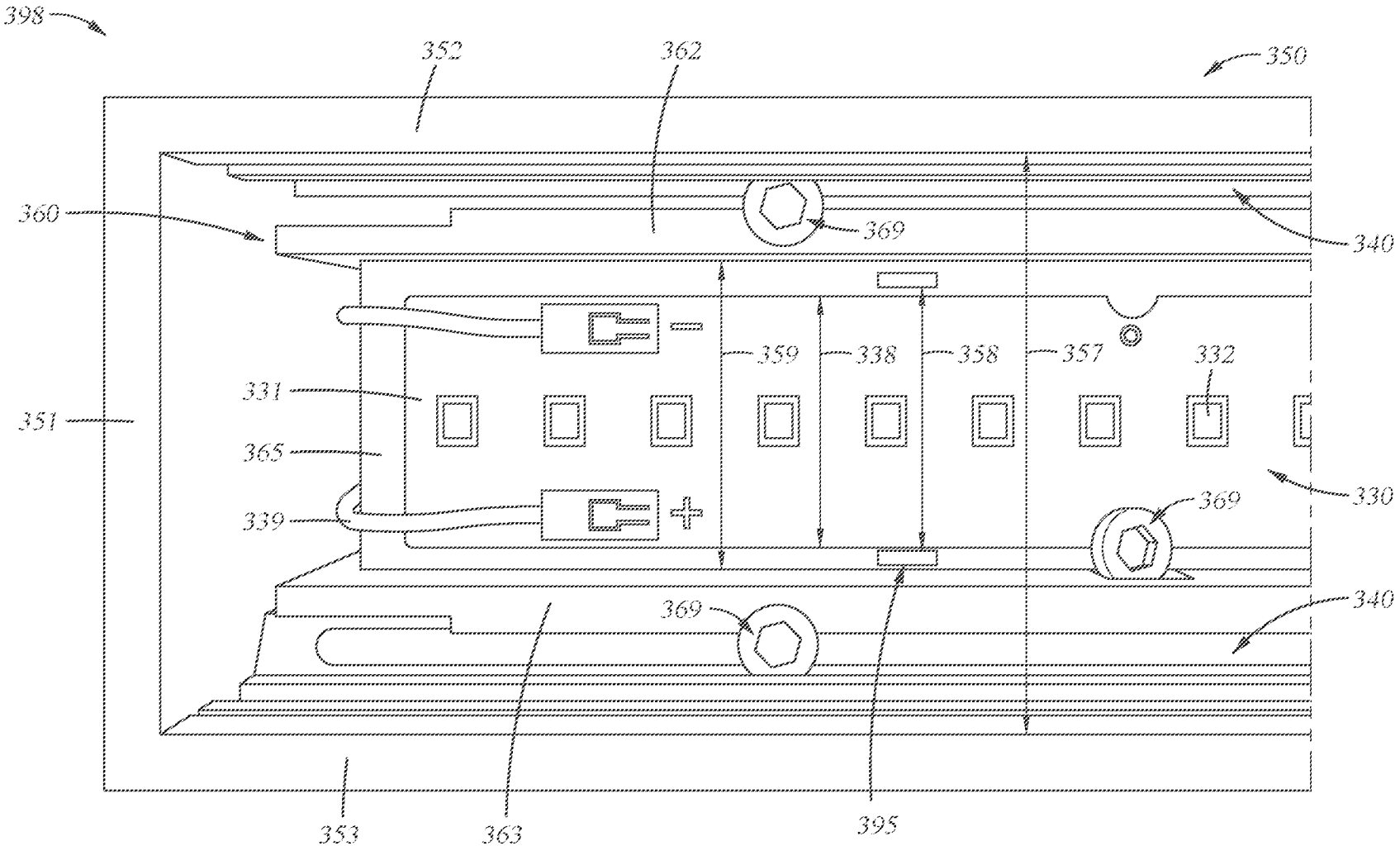
FIG. 3 shows a portion of a linear light fixture in accordance with certain example embodiments.

FIG. 3 shows a portion of a linear light fixture 398 in accordance with certain example embodiments. Referring to FIGS. 1-3, most of the features and components of the portion of the linear light fixture 398 of FIG. 3 are substantially the same as the corresponding features and components of the linear light fixtures of FIGS. 1 and 2. For example, the housing 350 of the linear light fixture 398 of FIG. 3 has one or more walls (e.g., top wall 352, left side wall 351, bottom wall 353), and one or more of these walls (in this case, top wall 352 and bottom wall 353) can include one or more coupling features 340 (in this case, slots) used to slidably receive a lens (not shown in FIG. 3). The coupling features 340 in this case are positioned toward the distal end of the top wall 352 and the bottom wall 353 of the housing 350. The top wall 352 and the bottom wall 353 are separated from each other by distance 357.

Also shown in FIG. 3, which is a common feature in linear light fixtures currently used in the art, is a removable insert 360. In some cases, the insert 360 can be considered a removable part of the housing 350. The insert 360 can be completely disposed within a cavity formed by the walls of the housing 350. The insert 360 can be secured to the housing 350 using one or more coupling features 369 (e.g., screws). The insert 360 can have one or more walls. For example, in this case, the insert 360 includes a base wall 365, a top wall 362 that extends from one side of the base wall 365, and a bottom wall 363 that extends from an opposite side of the base wall 365. In this case, the top wall 362 and the bottom wall 363 each form an angle that is substantially perpendicular with the base wall 365. In other cases, such as in FIGS. 10A and 10B below, the top wall and the bottom wall of an insert can each extend at an obtuse angle from the base wall. The top wall 362 and the bottom wall 363 can be separated from each other by a distance 359, which in this case is also the width of the base wall 365 of the insert 360.

When an insert 360 is included with the housing 350, the lighting assembly 330 can be disposed thereon. For example, in this case, the circuit board 331 of the lighting assembly 330 is disposed on the base wall 365 of the insert 360. The circuit board 331 can be coupled to the base wall 365 using one or more coupling features 369 (e.g., screws). Disposed on the circuit board 331 in this case are a number of light sources 332 (in this case, LEDs). There are also two electrical conductors 339 connected to two electrical connector ends, which in turn are connected to the circuit board 331. The circuit board 331 has a width 338 that is less than the distance 359 between the top wall 362 and the bottom wall 363 of the insert 360.

While all of the above can be found in linear light fixtures currently known in the art, one differentiating feature used with example embodiments are the one or more coupling features 395 disposed in the housing 350. Specifically, in this case, there are two coupling features 395, identical to each other, that are disposed in the base wall 365 of the insert 360 of the housing 350, spaced equidistantly from the circuit board 331 of the lighting assembly 330 and also spaced some distance (e.g., one inch, two inches) from the left side wall 351 of the housing 350. In this case, the two coupling features 395 are slots that are separated from each other by a distance 358, which is greater than the width 338 of the circuit board 331 and less than the width 359 of the base wall 365 of the insert 360. The shape, size, configuration, position, and other characteristics of the coupling features 395 are based on the complementary coupling features of an auxiliary optical member, as discussed below, for example, with respect to FIGS. 4A, 4B, and 7.

Figure 4B:
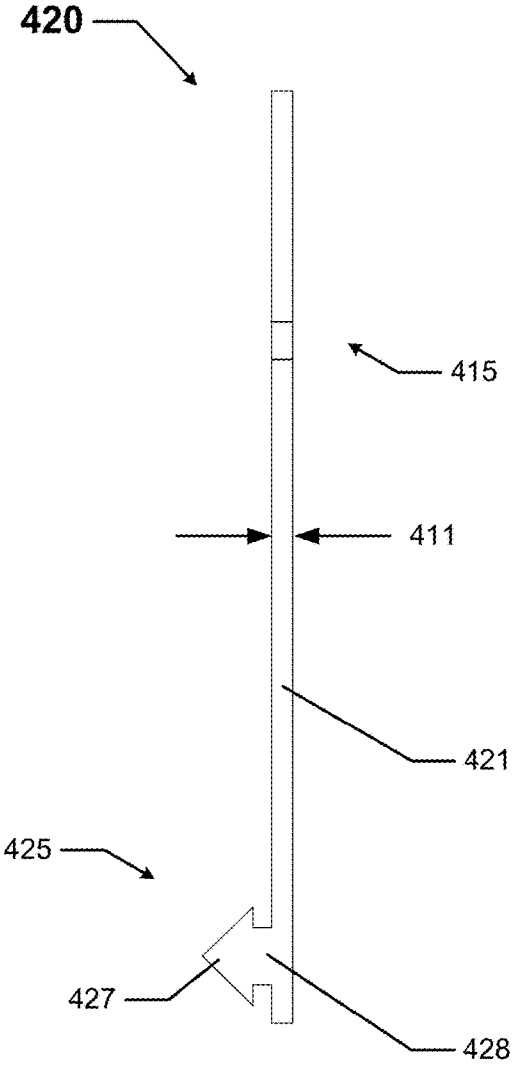
FIGS. 4A and 4B show various views of an auxiliary optical member in accordance with certain example embodiments.
Figure 4A:
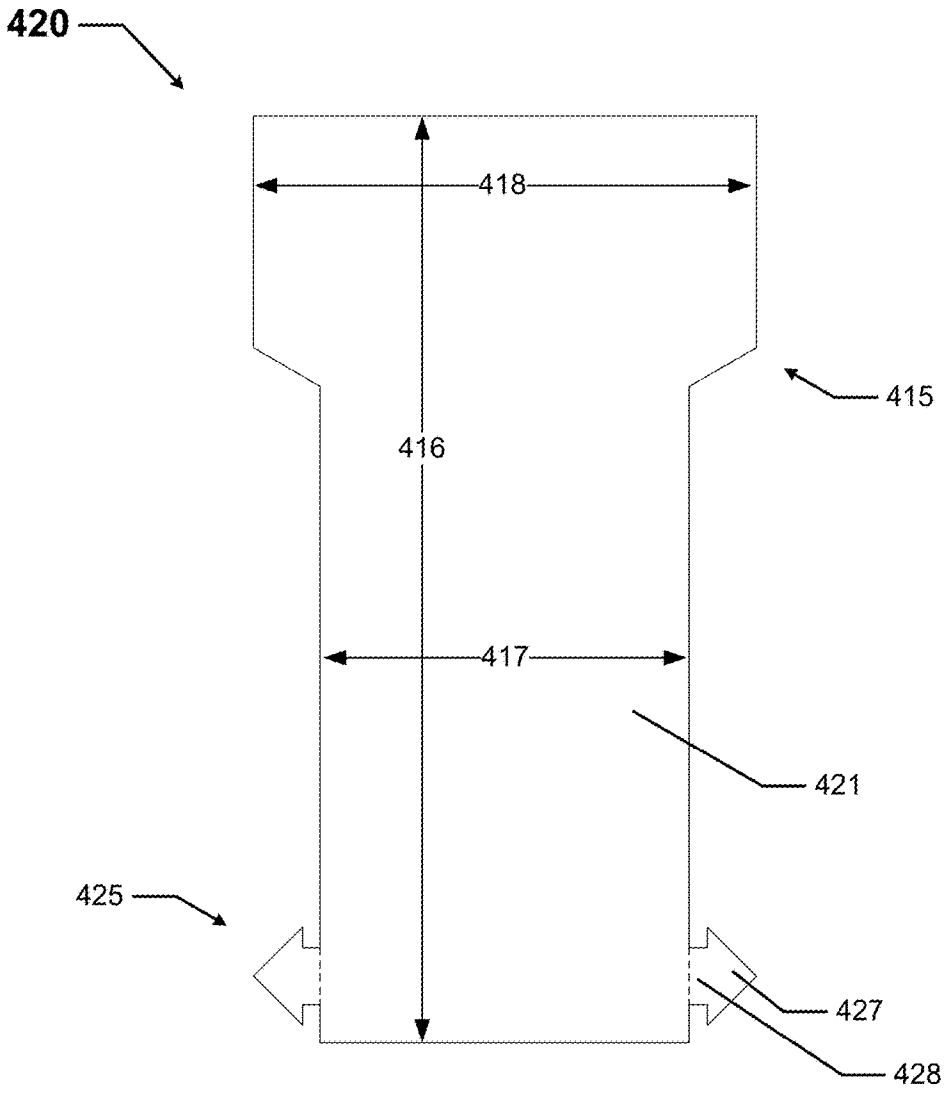

FIGS. 4A and 4B show various views of an auxiliary optical member 420 in accordance with certain example embodiments. Specifically, FIG. 4A shows a front view of the auxiliary optical member 420, and FIG. 4B shows a side view of the auxiliary optical member 420. An auxiliary optical member (such as the auxiliary optical member 420 of FIGS. 4A and 4B) described herein can be considered a type of an example light leak solution for linear light fixtures.

Referring to FIGS. 1-4B, the auxiliary optical member 420 of FIGS. 4A and 4B includes a body 421 having a thickness 411 (e.g., 6 mm, 7 mm) and a height 416 (e.g., 2 inches, 3 inches). The thickness 411 of the body 421 of the auxiliary optical member 420 can be uniform or variable along the height 416. If the thickness 411 of the body 421 of the auxiliary optical member 420 is variable along the height 416, then the variability can have any of a number of characteristics (e.g., increasing, decreasing, linear, random).

The body 421 of the auxiliary optical member 420 can also have a width 417. The width 417 of the body 421 of the auxiliary optical member 420 can be constant or variable along the height 416 of the body 421 of the auxiliary optical member 420. For example, in this case, the width 417 of the body 421 of the auxiliary optical member 420 in this case is substantially constant (aside from the area of the coupling feature 415) along the height 416 of the body 421 of the auxiliary optical member 420. By contrast, as shown for example in FIG. 7, the width of the body of an auxiliary optical member can be variable (e.g., tapered) along the height of the body of the auxiliary optical member.

In any case, the width (e.g., width 417) of the body (e.g., body 421) of an auxiliary optical member (e.g., auxiliary optical member 420) can be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when an auxiliary optical member is positioned relative to an insert of a linear light fixture, there is little to no space between the body of the auxiliary optical member and the top wall/bottom wall of the insert along the height of the body of the auxiliary optical member.

Toward the bottom end of the auxiliary optical member 420 can be disposed one or more coupling features 425. Such coupling features 425 can be used to secure the bottom end of the auxiliary optical member 420 relative to one or more portions of the housing 350 (e.g., the coupling features 395 of the insert 360). In this case, there are two coupling features 425, one extending from each side of the body 421 of the auxiliary optical member 420 toward the bottom end of the auxiliary optical member 420. The two coupling features 425 in this example are substantially identical to each other. Specifically, each coupling feature 425 includes an extension 427 in the shape of an arrowhead extending laterally away from the body 421 of the auxiliary optical member 420.

In alternative embodiments, a coupling feature 425 can have any of a number of other shapes, sizes, locations on the body, and/or other characteristics so that the coupling feature 425 can properly and securely couple to a complementary coupling feature of the housing (e.g., housing 350). In certain example embodiments, such as is shown in FIG. 4B, each coupling feature 425 is flexible (e.g., bendable). In this way, each coupling feature 425 can be manipulated relative to the body 421 of the auxiliary optical member 420 so that the coupling feature 425 can properly and securely couple to the complementary coupling features (e.g., coupling features 395) of the housing (e.g., housing 350) of the linear light fixture.

Toward the top end of the auxiliary optical member 420 can be disposed one or more coupling features 415. Such coupling features 415 can be used to secure the top end of the auxiliary optical member 420 relative to one or more portions of the housing 350 (e.g., the left side wall 351, the portions of the top wall 352 and the bottom wall 353 disposed above the insert 360). In this case, there are two coupling features 415, one extending from each side of the body 421 of the auxiliary optical member 420 toward the top end of the auxiliary optical member 420. The two coupling features 415 in this example are substantially identical to each other. Specifically, each coupling feature 415 includes an extension in the shape of a flap extending laterally away from the body 421 of the auxiliary optical member 420.

Since the coupling features 415 extend away from the body 421 of the auxiliary optical member 420, the width 418 of the coupling features 415 is larger than the width 417 of the body 421 of the auxiliary optical member 420. In some cases, one or more other coupling features can be part of the auxiliary optical member 420. For example, adhesive can be disposed on the back side of the body 421 toward the top end of the auxiliary optical member 420.

Figure 5:
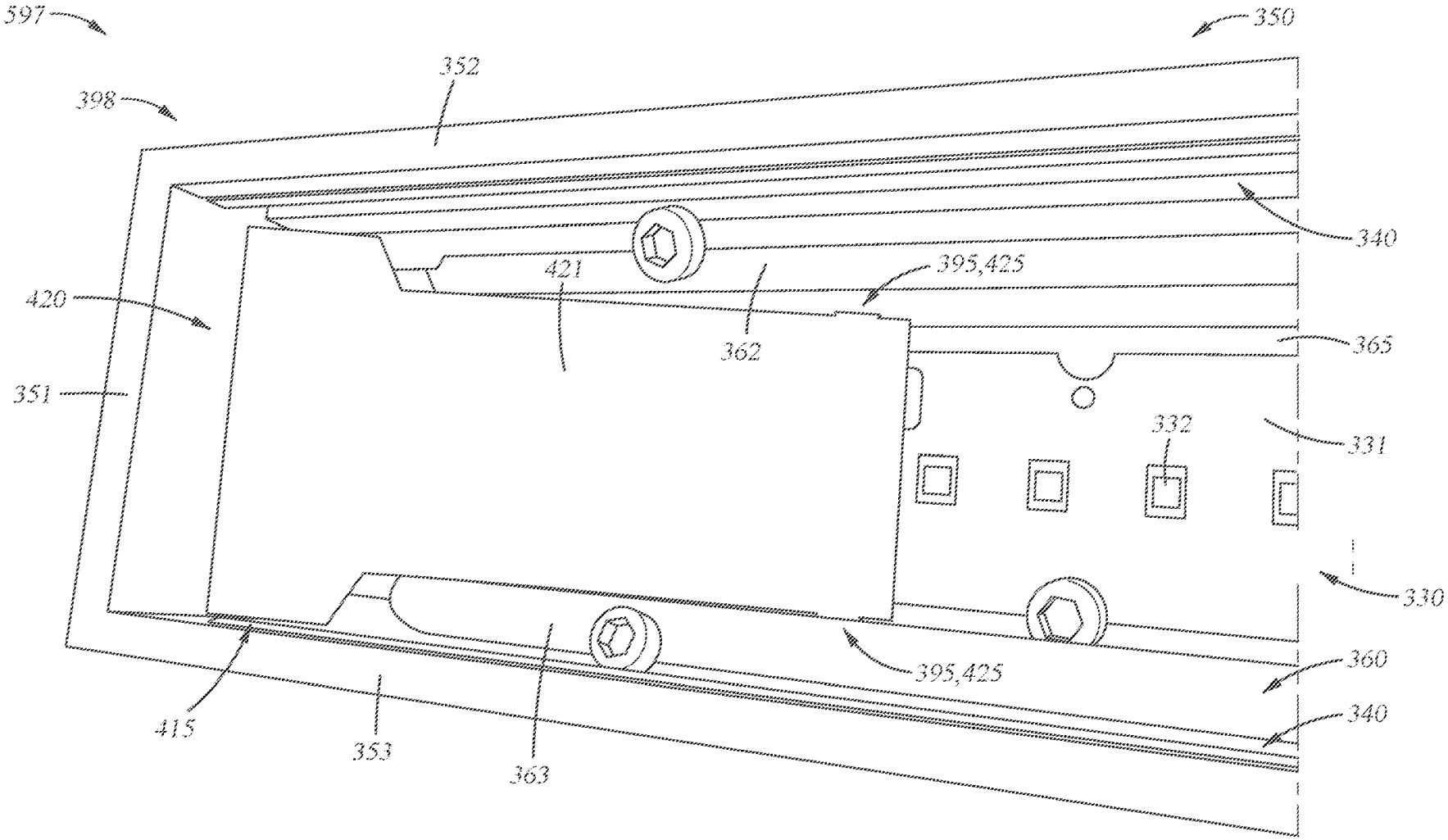
FIG. 5 shows another portion of a linear light fixture that includes the portion of the linear light fixture shown in FIG. 3 and the auxiliary optical member shown in FIGS. 4A and 4B.

FIG. 5 shows a portion of a linear light fixture 597 that includes the portion of the linear light fixture 398 shown in FIG. 3 and the auxiliary optical member 420 shown in FIGS. 4A and 4B. Referring to FIGS. 1-5, the auxiliary optical member 420 is coupled to and disposed within the housing 350 of the linear light fixture 398. Specifically, the coupling features 425 of the auxiliary optical member 420 are coupled to the coupling features 395 disposed in the base wall 365 of the insert 360. Further, the coupling features 415 of the auxiliary optical member 420 are coupled to (in this case, abut against) the inner surfaces of the top wall 352 and the bottom wall 353 disposed above the insert 360 and below the coupling features 340 of the housing 350.

The top end of the body 421 of the auxiliary optical member 420 can also abut against the inner surface of the left side wall 351 of the housing 350. When the auxiliary optical member 420 is positioned as shown in FIG. 5, the auxiliary optical member 420 effectively covers some amount (e.g., 2 inches) of the distal end of the circuit board 331 of the lighting assembly 330. Specifically, the bottom end of the auxiliary optical member 420 abuts against the circuit board 331, and the body 421 of the auxiliary optical member 420 extends linearly away from the circuit board 331 until the top end of the auxiliary optical member 420 abuts the inner surface of the left side wall 351 toward the top of the left side wall 351 of the housing 350. In this case, the body 421 (which can include the coupling features 415) can have a substantially uniform diffusion along the height 416 and the width (e.g., width 417, width 418) of the auxiliary optical member 420.

Figure 6:
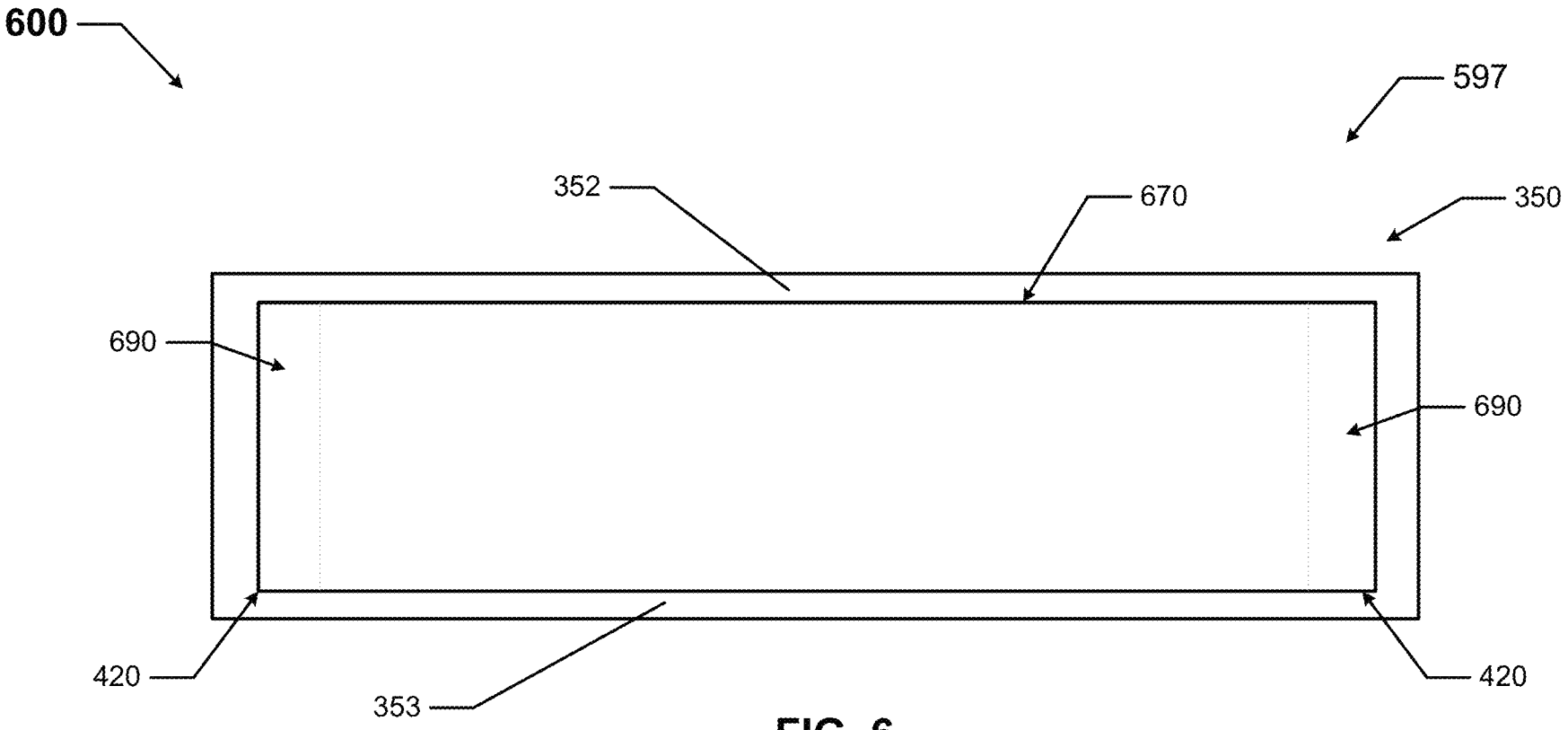
FIG. 6 shows a linear light fixture that includes the lighting assembly of FIG. 5.

FIG. 6 shows a top view of a linear light fixture 600 that includes the lighting assembly 597 of FIG. 5. Referring to FIGS. 1-6, the linear light fixture 600 of FIG. 6 includes the portion of the linear light fixture 597 of FIG. 5 with a lens 670 inserted into the coupling features (element 340 in FIGS. 3 and 5, but hidden from view here) of the housing 350, so that the lens 670 is perpendicular with the top wall 352 and the bottom wall 353 of the housing 350. Here, the lens 670 is centered between the left side wall 351 and the right side wall 354 of the housing 350, which means that there is a gap 690 between the left edge of the lens 670 and the left side wall 351, and another gap 690 between the right edge of the lens 670 and the right side wall 354.

Unlike what is shown in FIGS. 1 and 2 in the current art, parts of the lighting assembly 330 are not visible through the gaps 690 to a user standing under the linear light fixture 600. Instead, one auxiliary optical member 420 covers the gap 690 on the left side, and another auxiliary optical member 420 covers the gap 690 on the right side. Further, because of the diffusion characteristics of the body 421 of the auxiliary optical member 420, the light emitted by the light sources 332 of the lighting assembly 330 that traverses an auxiliary optical member 420 will have the same optical characteristics relative to the light that traverses the lens 670. In other words, a user looking at light emitted by the linear light fixture 600 cannot tell a difference between light that traverses an auxiliary optical member 420 and light that traverses the lens 670.

Figure 7:
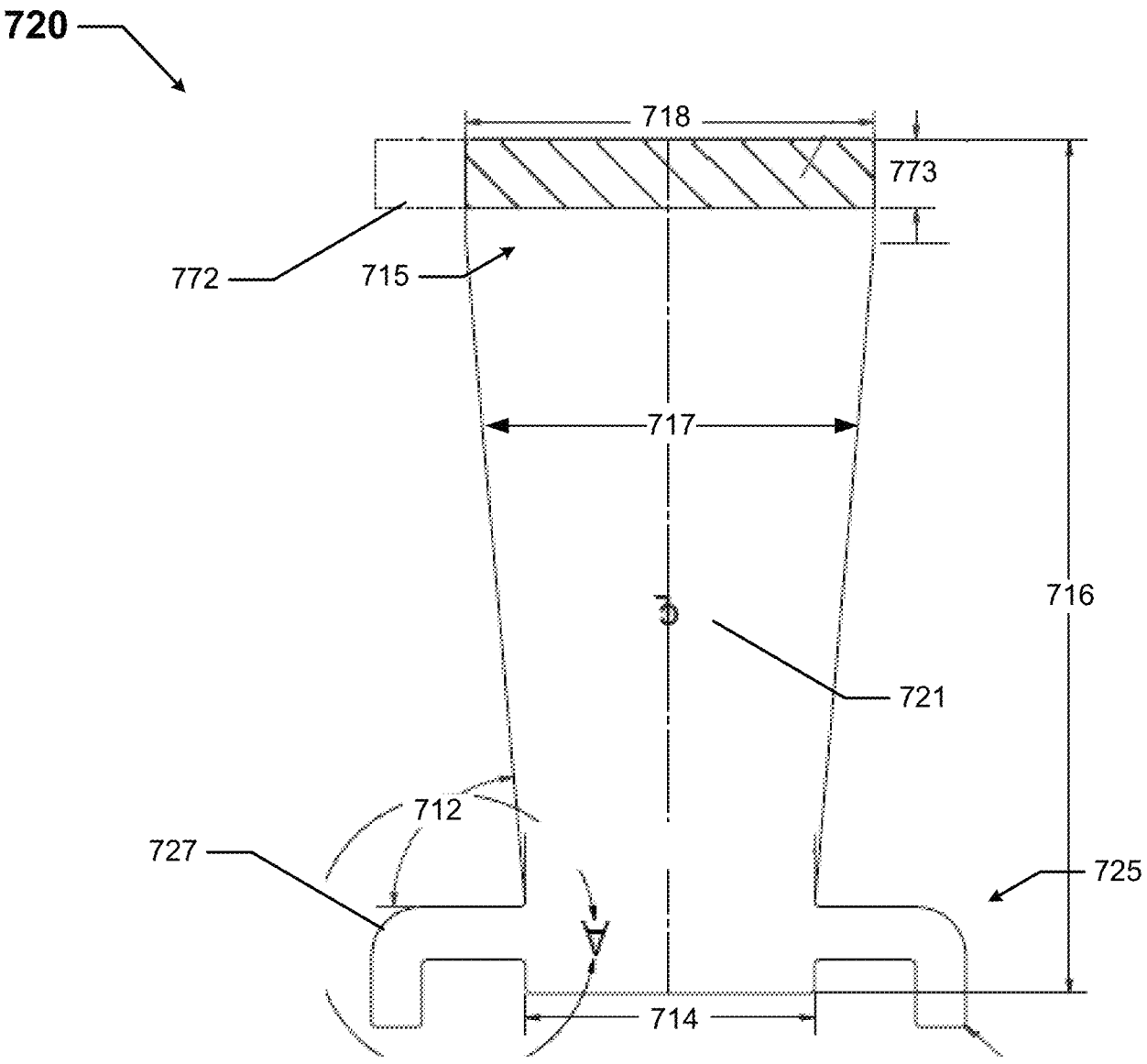
FIG. 7 shows another auxiliary optical member in accordance with certain example embodiments.

FIG. 7 shows another auxiliary optical member 720 in accordance with certain example embodiments. Referring to FIGS. 1-7, the auxiliary optical member 720 of FIG. 7 includes a body 721 having a thickness (similar to what is shown with the thickness 411 of the auxiliary optical member 420 of FIGS. 4A and 4B) and a height 716. The thickness of the body 721 of the auxiliary optical member 720 can be uniform or variable along the height 716. If the thickness of the body 721 of the auxiliary optical member 720 is variable along the height 716, then the variability can have any of a number of characteristics (e.g., increasing, decreasing, linear, random).

The body 721 of the auxiliary optical member 720 can also have a width 717. The width 717 of the body 721 of the auxiliary optical member 720 in this case is variable along the height 716 of the body 721 of the auxiliary optical member 720. Specifically, the width 717 of the body 721 of the auxiliary optical member 720 is linearly variable (e.g., tapered) along the height 716 of the body 721 of the auxiliary optical member 720, ranging from distance 714 at the bottom end of the body 721 to distance 718 at the top end of the body 721.

The width 717 of the body 721 of the auxiliary optical member 720 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 720 is positioned relative to an insert of a linear light fixture, there is little to no space between the body 721 of the auxiliary optical member 720 and the top wall/bottom wall of the insert along the height 716 of the body 721 of the auxiliary optical member 720.

Toward the bottom end of the auxiliary optical member 720 can be disposed one or more coupling features 725 used to secure the bottom end of the auxiliary optical member 720 relative to one or more portions of the housing (e.g., the coupling features 395 of the insert 360). In this case, there are two coupling features 725, one extending from each side of the body 721 of the auxiliary optical member 720 toward the bottom end of the auxiliary optical member 720. The two coupling features 725 in this example are substantially identical to each other. Specifically, each coupling feature 725 includes a L-shaped extension 727 that initially extends laterally away from the body 721 of the auxiliary optical member 720, and then makes a 90° turn upward.

Each coupling feature 725 can be flexible (e.g., bendable). In this way, each coupling feature 725 can be manipulated relative to the body 721 of the auxiliary optical member 720 so that the coupling feature 725 can properly and securely couple to the complementary coupling features (e.g., coupling features 395) of the housing (e.g., housing 350) of the linear light fixture. The initial part of the extension 727 of each coupling feature 725 forms an angle 712 with the adjacent outer edge of the body 721 of the auxiliary optical member 720.

Toward the top end of the auxiliary optical member 720 can be disposed one or more coupling features 715. Such coupling features 715 can be used to secure the top end of the auxiliary optical member 720 relative to one or more portions of a housing (e.g., the left side wall 351, the portions of the top wall 352 and the bottom wall 353 disposed above the insert 360). In this case, there is one coupling feature 715 disposed along the back surface of the body 721 of the auxiliary optical member 720 toward the top end of the auxiliary optical member 720. The coupling feature 715 in this example is an adhesive that is covered with a removable protective strip 772. The adhesive covers a distance 773 from the top edge of the body 721 of the auxiliary optical member 720 along the entire width 717 (in this case, distance 718) of the body 721. In order for the coupling feature 715 to adhere to a side wall of the housing, the top end of the body 721 of the auxiliary optical member 720 can be flexible (e.g., bendable).

Figure 8B:
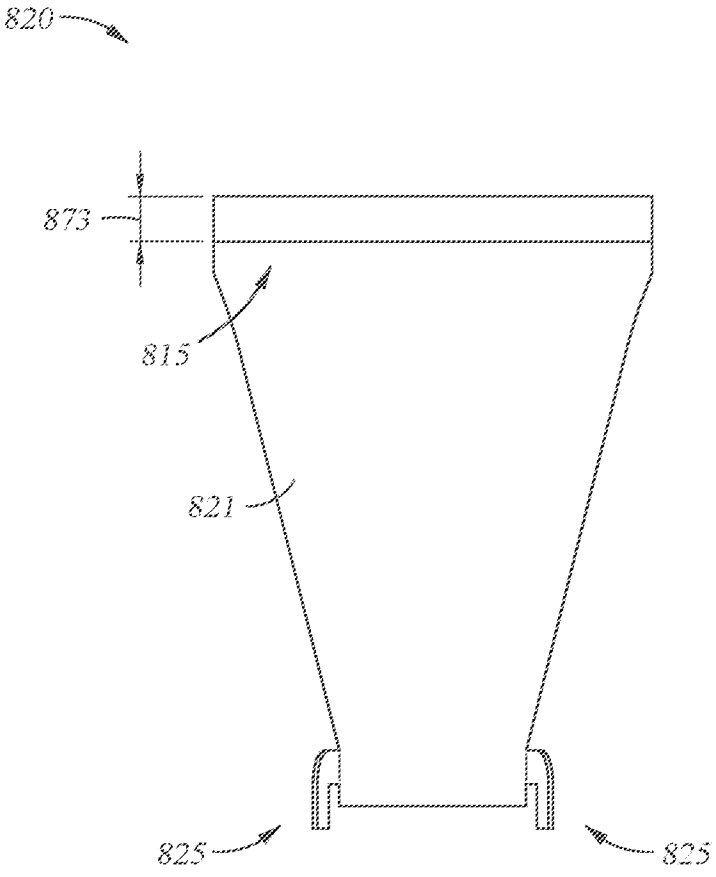
FIGS. 8A and 8B show yet another auxiliary optical member in accordance with certain example embodiments.
Figure 8A:
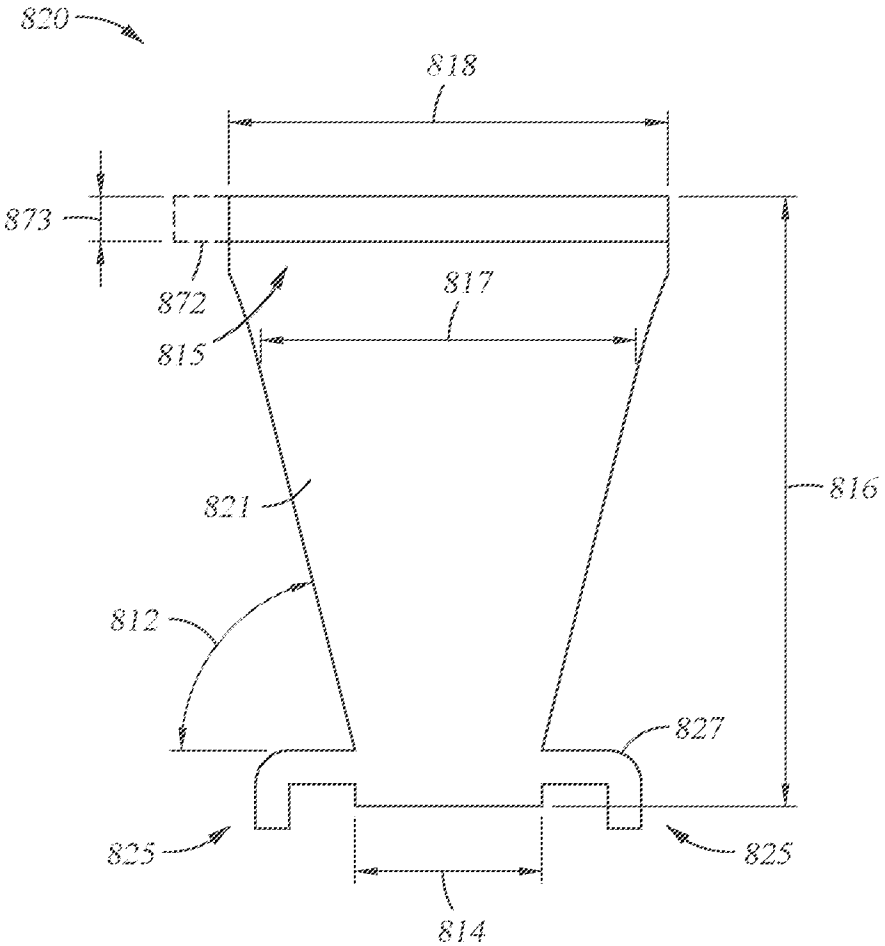

FIGS. 8A and 8B show yet another auxiliary optical member 820 in accordance with certain example embodiments. Specifically, FIG. 8A shows a front view of the auxiliary optical member 820 with coupling features 825 in a natural state, and FIG. 8B shows a front view of the auxiliary optical member 820 with coupling features 825 in a bent position. Referring to FIGS. 1-8B, the auxiliary optical member 820 of FIGS. 8A and 8B includes a body 821 having a thickness (similar to what is shown with the thickness 411 of the auxiliary optical member 420 of FIGS. 4A and 4B) and a height 816. The thickness of the body 821 of the auxiliary optical member 820 can be uniform or variable along the height 816. If the thickness of the body 821 of the auxiliary optical member 820 is variable along the height 816, then the variability can have any of a number of characteristics (e.g., increasing, decreasing, linear, random).

The body 821 of the auxiliary optical member 820 can also have a width 817. The width 817 of the body 821 of the auxiliary optical member 820 in this case is variable along the height 816 of the body 821 of the auxiliary optical member 820. Specifically, the width 817 of the body 821 of the auxiliary optical member 820 is linearly variable (e.g., tapered) along the height 816 of the body 821 of the auxiliary optical member 820, ranging from distance 814 at the bottom end of the body 821 to distance 818 at the top end of the body 821.

The width 817 of the body 821 of the auxiliary optical member 820 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 820 is positioned relative to an insert of a linear light fixture, there is little to no space between the body 821 of the auxiliary optical member 820 and the top wall/bottom wall of the insert along the height 816 of the body 821 of the auxiliary optical member 820.

Toward the bottom end of the auxiliary optical member 820 can be disposed one or more coupling features 825 used to secure the bottom end of the auxiliary optical member 820 relative to one or more portions of the housing (e.g., the coupling features 395 of the insert 360). In this case, there are two coupling features 825, one extending from each side of the body 821 of the auxiliary optical member 820 toward the bottom end of the auxiliary optical member 820. The two coupling features 825 in this example are substantially identical to each other. Specifically, each coupling feature 825 includes a L-shaped extension 827 that initially extends laterally away from the body 821 of the auxiliary optical member 820, and then makes a 90° turn downward.

Each coupling feature 825 can be flexible (e.g., bendable), as shown in FIG. 8B. In this way, each coupling feature 825 can be manipulated relative to the body 821 of the auxiliary optical member 820 so that the coupling feature 825 can properly and securely couple to the complementary coupling features (e.g., coupling features 395) of the housing (e.g., housing 350) of the linear light fixture. The initial part of the extension 827 of each coupling feature 825 forms an angle 812 with the adjacent outer edge of the body 821 of the auxiliary optical member 820. The width 817 of the body 821 becomes greater than the width 717 of the body 721 of the auxiliary optical member 720 of FIG. 7, which also means that the angle 812 is less than the corresponding angle 712 of FIG. 7.

Toward the top end of the auxiliary optical member 820 can be disposed one or more coupling features 815. Such coupling features 815 can be used to secure the top end of the auxiliary optical member 820 relative to one or more portions of a housing (e.g., the left side wall 351, the portions of the top wall 352 and the bottom wall 353 disposed above the insert 360). In this case, there is one coupling feature 815 disposed along the back surface of the body 821 of the auxiliary optical member 820 toward the top end of the auxiliary optical member 820. The coupling feature 815 in this example is an adhesive that is covered with a removable protective strip 872. The adhesive covers a distance 873 from the top edge of the body 821 of the auxiliary optical member 820 along the entire width 817 (in this case, distance 818) of the body 821. In order for the coupling feature 815 to adhere to a side wall of the housing, the top end of the body 821 of the auxiliary optical member 820 can be flexible (e.g., bendable).

Figure 9B:
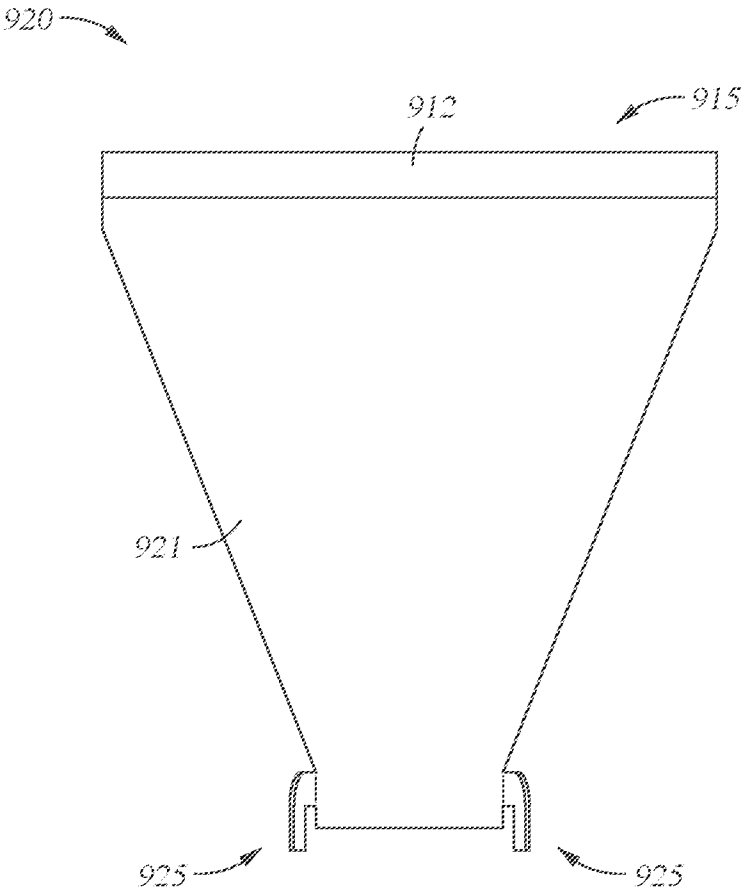
FIGS. 9A and 9B show still another auxiliary optical member in accordance with certain example embodiments.
Figure 9A:
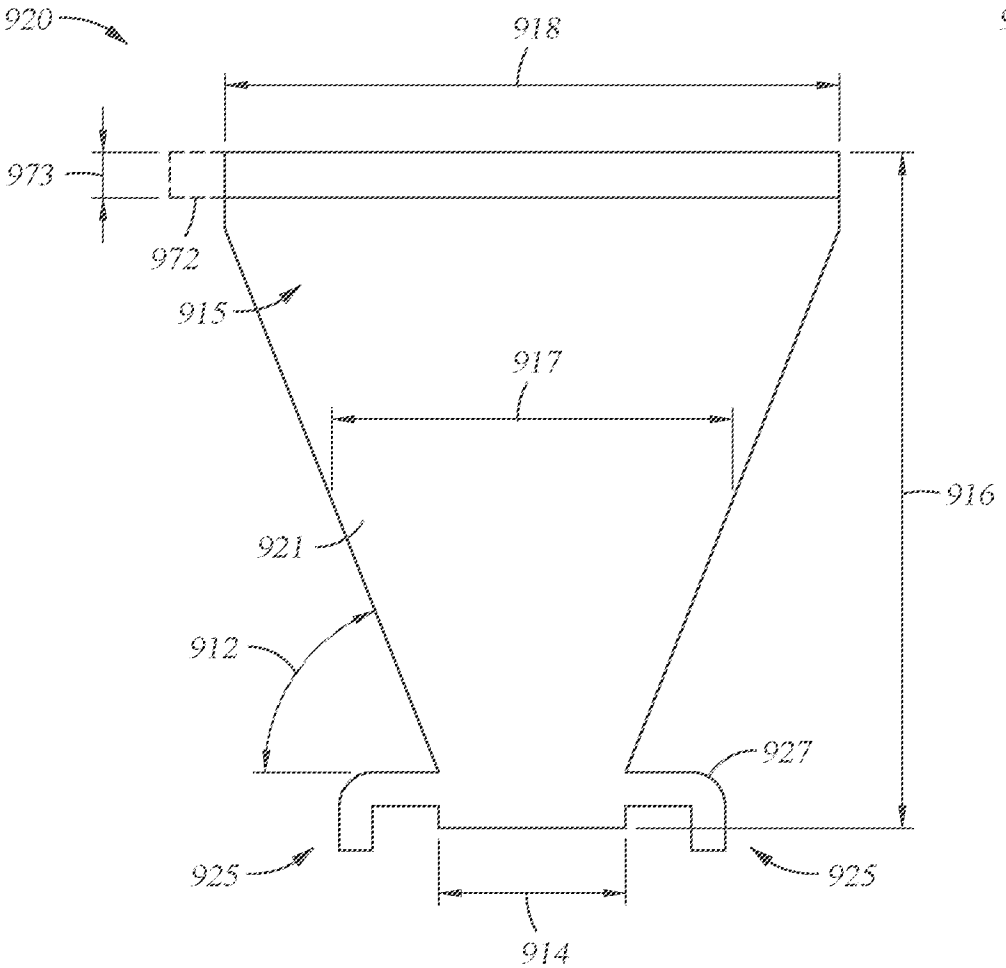

FIGS. 9A and 9B show still another auxiliary optical member 920 in accordance with certain example embodiments. Specifically, FIGS. 9A and 9B each shows a front view of the auxiliary optical member 920 with coupling features 925 in a natural state. Referring to FIGS. 1-9B, the auxiliary optical member 920 of FIGS. 9A and 9B includes a body 921 having a thickness (similar to what is shown with the thickness 411 of the auxiliary optical member 420 of FIGS. 4A and 4B) and a height 916. The thickness of the body 921 of the auxiliary optical member 920 can be uniform or variable along the height 916. If the thickness of the body 921 of the auxiliary optical member 920 is variable along the height 916, then the variability can have any of a number of characteristics (e.g., increasing, decreasing, linear, random).

The body 921 of the auxiliary optical member 920 can also have a width 917. The width 917 of the body 921 of the auxiliary optical member 920 in this case is variable along the height 916 of the body 921 of the auxiliary optical member 920. Specifically, the width 917 of the body 921 of the auxiliary optical member 920 is linearly variable (e.g., tapered) along the height 916 of the body 921 of the auxiliary optical member 920, ranging from distance 914 at the bottom end of the body 921 to distance 918 at the top end of the body 921.

The width 917 of the body 921 of the auxiliary optical member 920 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 920 is positioned relative to an insert of a linear light fixture, there is little to no space between the body 921 of the auxiliary optical member 920 and the top wall/bottom wall of the insert along the height 916 of the body 921 of the auxiliary optical member 920.

Toward the bottom end of the auxiliary optical member 920 can be disposed one or more coupling features 925 used to secure the bottom end of the auxiliary optical member 920 relative to one or more portions of the housing (e.g., the coupling features 395 of the insert 360). In this case, there are two coupling features 925, one extending from each side of the body 921 of the auxiliary optical member 920 toward the bottom end of the auxiliary optical member 920. The two coupling features 925 in this example are substantially identical to each other. Specifically, each coupling feature 925 includes a L-shaped extension 927 that initially extends laterally away from the body 921 of the auxiliary optical member 920, and then makes a 90° turn downward.

Each coupling feature 925 can be flexible (e.g., bendable), as shown in FIG. 9B. In this way, each coupling feature 925 can be manipulated relative to the body 921 of the auxiliary optical member 920 so that the coupling feature 925 can properly and securely couple to the complementary coupling features (e.g., coupling features 395) of the housing (e.g., housing 350) of the linear light fixture. The initial part of the extension 927 of each coupling feature 925 forms an angle 912 with the adjacent outer edge of the body 921 of the auxiliary optical member 920. The width 917 of the body 921 becomes greater than the widths of the bodies of the auxiliary optical members of FIGS. 7-8B, which also means that the angle 912 is less than the corresponding angle 712 of FIG. 7 and the corresponding angle 812 of FIGS. 8A and 8B.

Toward the top end of the auxiliary optical member 920 can be disposed one or more coupling features 915. Such coupling features 915 can be used to secure the top end of the auxiliary optical member 920 relative to one or more portions of a housing (e.g., the left side wall 351, the portions of the top wall 352 and the bottom wall 353 disposed above the insert 360). In this case, there is one coupling feature 915 disposed along the back surface of the body 921 of the auxiliary optical member 920 toward the top end of the auxiliary optical member 920. The coupling feature 915 in this example is an adhesive that is covered with a removable protective strip 972. The adhesive covers a distance 973 from the top edge of the body 921 of the auxiliary optical member 920 along the entire width 917 (in this case, distance 919) of the body 921. In order for the coupling feature 915 to adhere to a side wall of the housing, the top end of the body 921 of the auxiliary optical member 920 can be flexible (e.g., bendable).

Figure 10A:
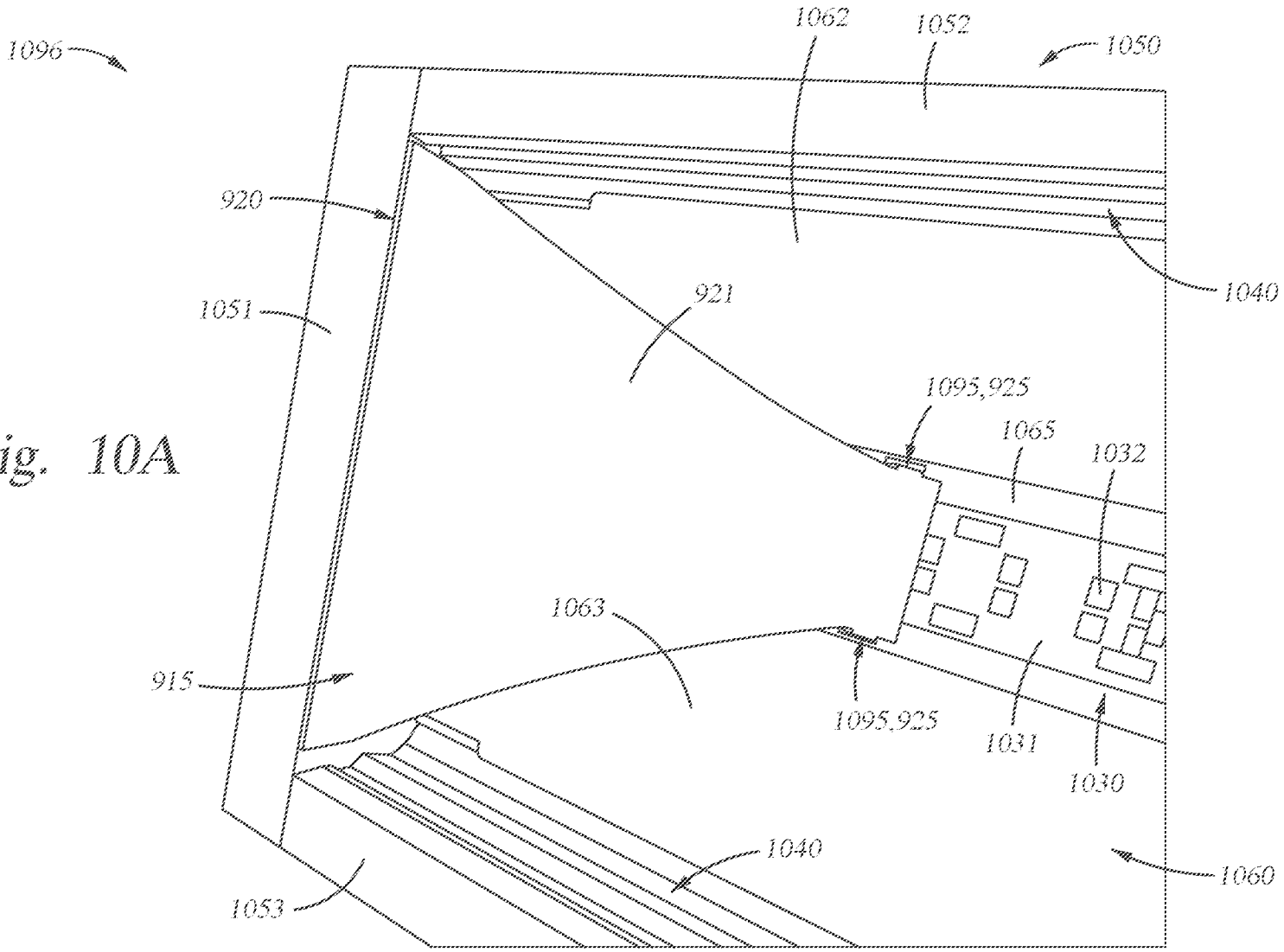
FIGS. 10A and 10B show a portion of another linear light fixture in which the auxiliary optical member of FIGS. 9A and 9B can be used.
Figure 10B:
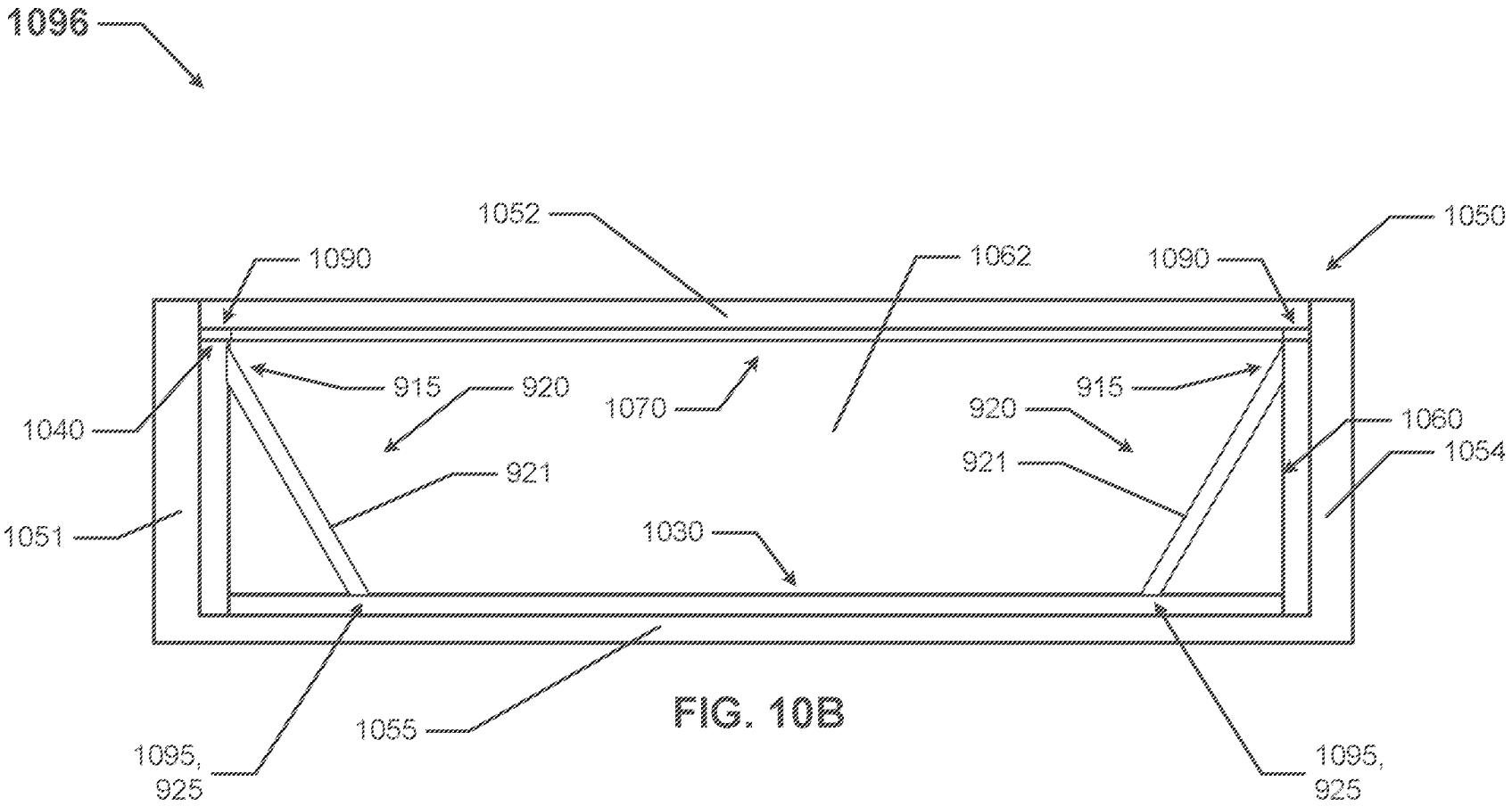

FIGS. 10A and 10B show a portion of another linear light fixture 1096 in which the auxiliary optical member 920 of FIGS. 9A and 9B can be used. Specifically, FIG. 10A shows a top-side perspective view a portion of the linear light fixture 1096 without a lens. FIG. 10B shows a cross-sectional side view of the linear light fixture 1096 with a lens 1070. Referring to FIGS. 1 through 10B, the auxiliary optical member 920 is coupled to and disposed within the housing 1050 of the linear light fixture 1096. Specifically, the coupling features 925 of the auxiliary optical member 920 are coupled to the coupling features 1095 disposed in the base wall 1065 of the insert 1060 of the housing 1050. Further, the coupling features 915 of the auxiliary optical member 920 are coupled to (in this case, adhered to) the inner surface of the left side wall 1051 of the housing 1050. The sides of the body 921 of the auxiliary optical member 920 also abut against at least a portion of the inner surface of the top wall 1062 and the bottom wall 1063 of the insert 1060. In this case, the sides of the body 921 of the auxiliary optical member 920 do not interact with (e.g., abut against) the coupling features 1040 of the housing 1050.

When the auxiliary optical member 920 is positioned as shown in FIGS. 10A and 10B, the auxiliary optical member 920 effectively covers some amount (e.g., 2 inches) of the distal end of the circuit board 1031 (including some of the light sources 1032 disposed on the circuit board 1031) of the lighting assembly 1030. Specifically, the bottom end of the auxiliary optical member 920 abuts against the circuit board 1031, and the body 921 of the auxiliary optical member 920 extends linearly away from the circuit board 1031 until the top end of the auxiliary optical member 920 abuts the inner surface of the left side wall 1051 toward the top of the left side wall 1051 of the housing 1050. The lens 1070 is inserted into the coupling features 1040 of the housing 1050, so that the lens 1070 is perpendicular with the top wall 1052 and the bottom wall 1053 of the housing 1050. Here, the lens 1070 is centered between the left side wall 1051 and the right side wall 1054 of the housing 1050, which means that there is a gap 1090 between the left edge of the lens 1070 and the left side wall 1051, and another gap 1090 between the right edge of the lens 1070 and the right side wall 1054. Because of how the auxiliary optical members 920 are positioned within the housing 1050 of the linear light fixture 1096, the gap 1090 on either side is covered by the auxiliary optical members 920. In this case, the body 921 of the auxiliary optical member 920 can have a substantially uniform diffusion along the height 916 and the width 917 of the auxiliary optical member 920. Further, because of the diffusion characteristics of the body 1021 of each auxiliary optical member 1020, the light emitted by the light sources 1032 of the lighting assembly 1030 that traverses an auxiliary optical member 1020 will have substantially the same optical characteristics relative to the light that traverses the lens 1070.

Figure 11:
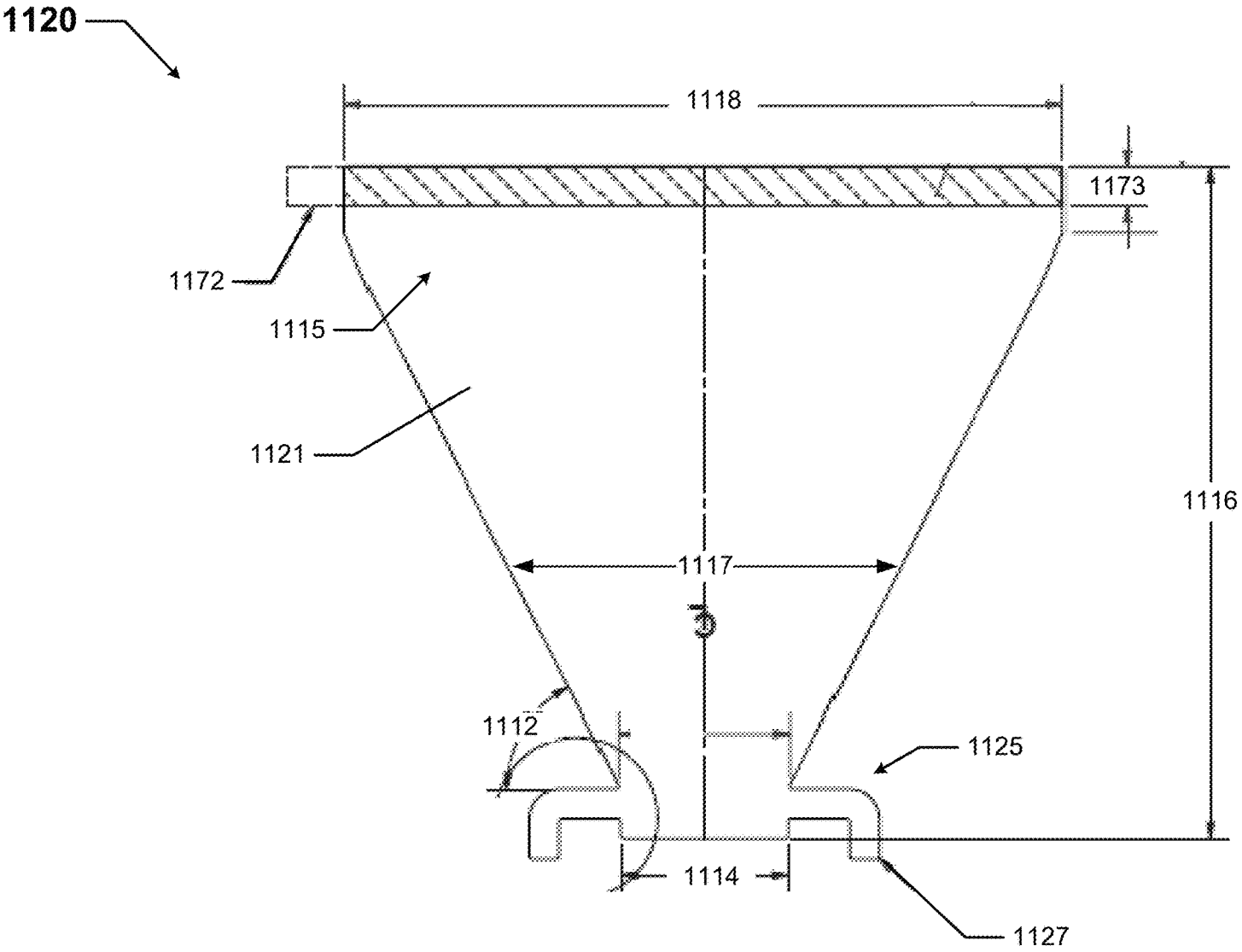
FIG. 11 shows yet another auxiliary optical member in accordance with certain example embodiments.

FIG. 11 shows yet another auxiliary optical member 1120 in accordance with certain example embodiments. Referring to FIGS. 1-11, the auxiliary optical member 1120 of FIG. 11 includes a body 1121 having a thickness (similar to what is shown with the thickness 411 of the auxiliary optical member 420 of FIGS. 4A and 4B) and a height 1116. The thickness of the body 1121 of the auxiliary optical member 1120 can be uniform or variable along the height 1116. If the thickness of the body 1121 of the auxiliary optical member 1120 is variable along the height 1116, then the variability can have any of a number of characteristics (e.g., increasing, decreasing, linear, random).

The body 1121 of the auxiliary optical member 1120 can also have a width 1117. The width 1117 of the body 1121 of the auxiliary optical member 1120 in this case is variable along the height 1116 of the body 1121 of the auxiliary optical member 1120. Specifically, the width 1117 of the body 1121 of the auxiliary optical member 1120 is linearly variable (e.g., tapered) along the height 1116 of the body 1121 of the auxiliary optical member 1120, ranging from distance 1114 at the bottom end of the body 1121 to distance 1118 at the top end of the body 1121.

The width 1117 of the body 1121 of the auxiliary optical member 1120 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 1120 is positioned relative to an insert of a linear light fixture, there is little to no space between the body 1121 of the auxiliary optical member 1120 and the top wall/bottom wall of the insert along the height 1116 of the body 1121 of the auxiliary optical member 1120.

Toward the bottom end of the auxiliary optical member 1120 can be disposed one or more coupling features 1125 used to secure the bottom end of the auxiliary optical member 1120 relative to one or more portions of the housing (e.g., the coupling features 395 of the insert 360). In this case, there are two coupling features 1125, one extending from each side of the body 1121 of the auxiliary optical member 1120 toward the bottom end of the auxiliary optical member 1120. The two coupling features 1125 in this example are substantially identical to each other. Specifically, each coupling feature 1125 includes a L-shaped extension 1127 that initially extends laterally away from the body 1121 of the auxiliary optical member 1120, and then makes a 90° turn downward.

Each coupling feature 1125 can be flexible (e.g., bendable), as shown in FIG. 11B. In this way, each coupling feature 1125 can be manipulated relative to the body 1121 of the auxiliary optical member 1120 so that the coupling feature 1125 can properly and securely couple to the complementary coupling features (e.g., coupling features 395) of the housing (e.g., housing 350) of the linear light fixture. The initial part of the extension 1127 of each coupling feature 1125 forms an angle 1112 with the adjacent outer edge of the body 1121 of the auxiliary optical member 1120. The width 1117 of the body 1121 becomes greater than the widths of the bodies of the auxiliary optical members of FIGS. 7-9, which also means that the angle 1112 is less than the corresponding angle 712 of FIG. 7, the corresponding angle 812 of FIGS. 8A and 8B, and the corresponding angle 912 of FIG. 9.

Toward the top end of the auxiliary optical member 1120 can be disposed one or more coupling features 1115. Such coupling features 1115 can be used to secure the top end of the auxiliary optical member 1120 relative to one or more portions of a housing (e.g., the left side wall 351, the portions of the top wall 352 and the bottom wall 353 disposed above the insert 360). In this case, there is one coupling feature 1115 disposed along the back surface of the body 1121 of the auxiliary optical member 1120 toward the top end of the auxiliary optical member 1120. The coupling feature 1115 in this example is an adhesive that is covered with a removable protective strip 1172. The adhesive covers a distance 1173 from the top edge of the body 1121 of the auxiliary optical member 1120 along the entire width 1117 (in this case, distance 1118) of the body 1121. In order for the coupling feature 1115 to adhere to a side wall of the housing, the top end of the body 1121 of the auxiliary optical member 1120 can be flexible (e.g., bendable).

Figure 12:
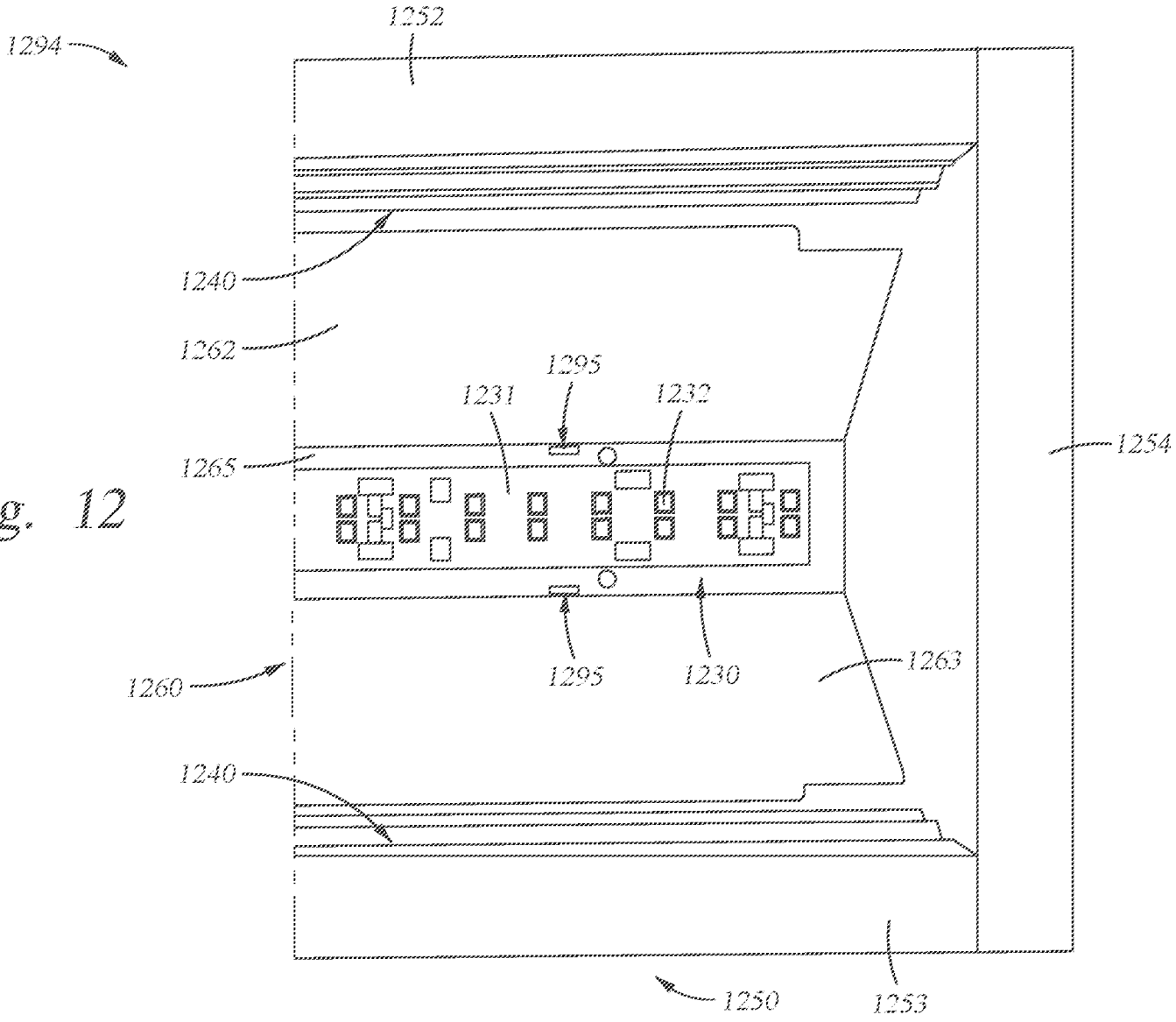
FIG. 12 shows a portion of another linear light fixture in which the auxiliary optical member of FIG. 11 can be used.

FIG. 12 shows a portion of another linear light fixture 1294 in which the auxiliary optical member 1120 of FIG. 11 can be used. Referring to FIGS. 1-12, most of the features and components of the portion of the linear light fixture 1294 of FIG. 12 are substantially the same as the corresponding features and components of the linear light fixtures of discussed above. For example, the housing 1250 of the portion of the linear light fixture 1294 of FIG. 12 has one or more walls (e.g., top wall 1252, right side wall 1254, bottom wall 1253), and one or more of these walls (in this case, top wall 1252 and bottom wall 1253) can include one or more coupling features 1240 (e.g., slots) used to slidably receive a lens (not shown in FIG. 12). The coupling features 1240 in this case are positioned toward the distal end of the top wall 1252 and the bottom wall 1253 of the housing 1250.

Also shown in FIG. 12 is a removable insert 1260. In some cases, the insert 1260 can be considered a removable part of the housing 1250. The insert 1260 can be completely disposed within a cavity formed by the walls of the housing 1250. The insert 1260 can be secured to the housing 1250 using one or more coupling features (not shown in FIG. 12). The insert 1260 can have one or more walls. For example, in this case, the insert 1260 includes a base wall 1265, a top wall 1262 that extends from one side of the base wall 1265, and a bottom wall 1263 that extends from an opposite side of the base wall 1265. In this case, the top wall 1262 and the bottom wall 1263 each form an obtuse angle with the base wall 1265.

When an insert 1260 is disposed within the housing 1250, the lighting assembly 1230 can be disposed thereon. For example, in this case, the circuit board 1231 of the lighting assembly 1230 is disposed on the base wall 1265 of the insert 1260. The circuit board 1231 can be coupled to the base wall 1265 using one or more coupling features (not shown in FIG. 12). Disposed on the circuit board 1231 in this case are a number of light sources 1232 (in this case, LEDs). The circuit board 1231 has a width that is less than the width of the base wall 1265 of the insert 1260.

The portion of the linear light fixture 1294 also includes two coupling features 1295, identical to each other, that are disposed in the base wall 1265 of the insert 1260 of the housing 1250, spaced equidistantly from the circuit board 1231 of the lighting assembly 1230. In this case, the two coupling features 1295 are slots that are separated from each other by a distance that is greater than the width of the circuit board 1231 and less than the width of the base wall 1265 of the insert 1260. In this case, the shape, size, configuration, position, and other characteristics of the coupling features 1295 are based on the complementary coupling features 1125 of the auxiliary optical member 1120.

Figure 13:
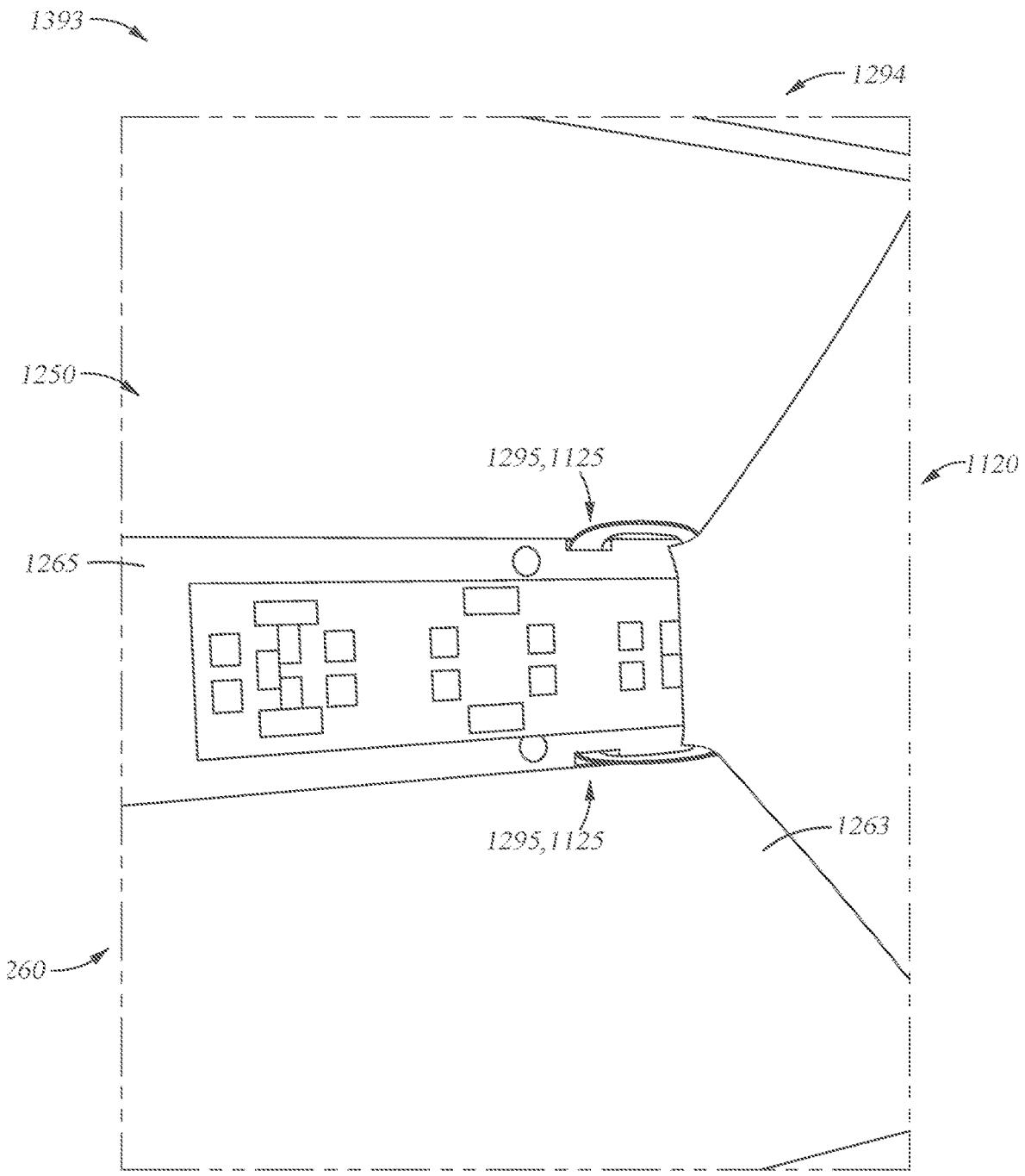
FIG. 13 shows another portion of a linear light fixture that includes the auxiliary optical member of FIG. 11 used with the portion of the linear light fixture of FIG. 12.

FIG. 13 shows another portion of a linear light fixture 1393 that includes the auxiliary optical member 1120 of FIG. 11 used with the portion of the linear light fixture 1294 of FIG. 12. Referring to FIGS. 1-13, the auxiliary optical member 1120 is being positioned within the housing 1350 of the portion of the linear light fixture 1393. Specifically, the coupling features 1125 of the auxiliary optical member 1120 are starting to be coupled to the coupling features 1295 disposed in the base wall 1265 of the insert 1260 of the housing 1250.

Figure 14:
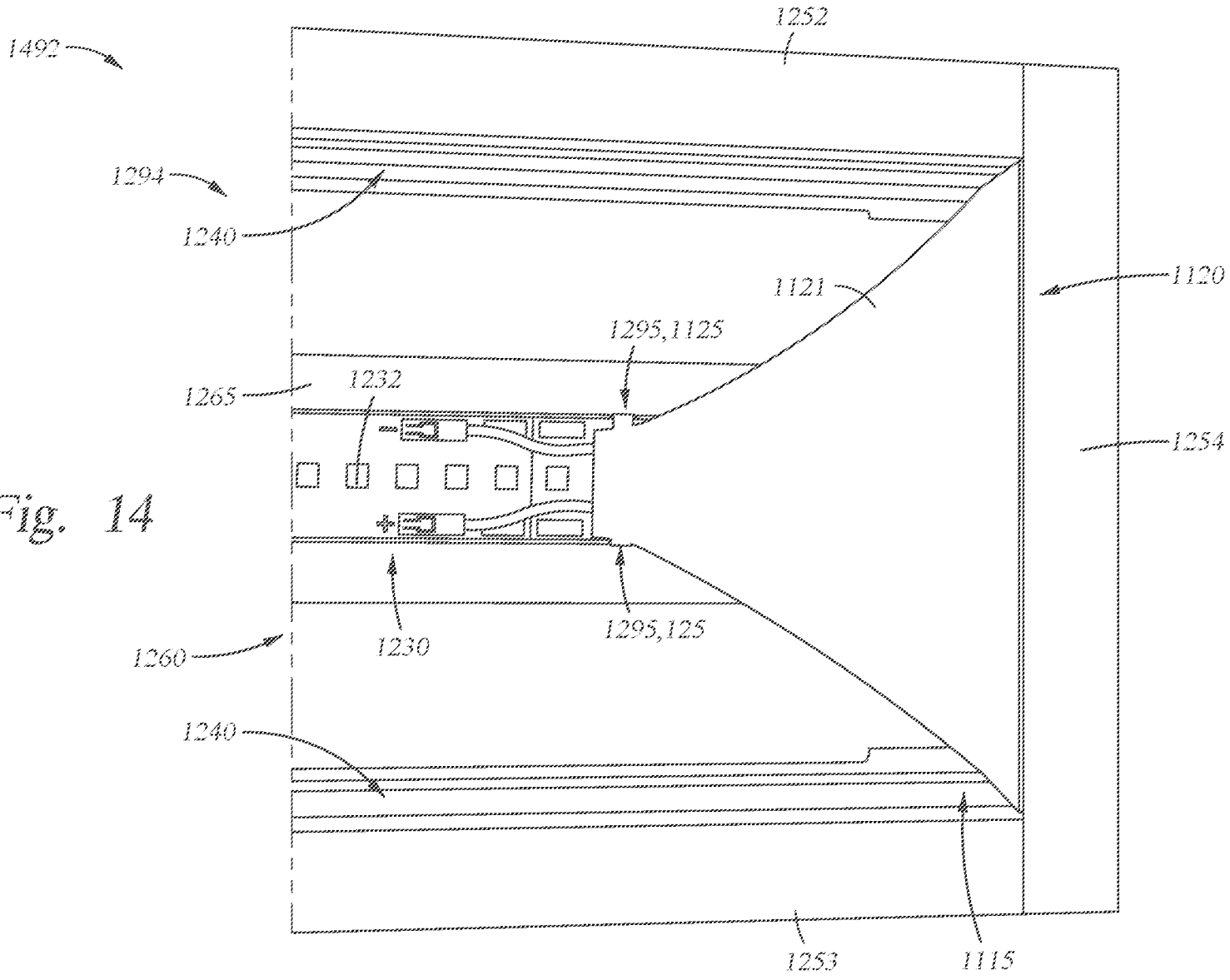
FIG. 14 shows the auxiliary optical member of FIG. 11 fully inserted into the portion of the linear light fixture of FIG. 12.

FIG. 14 shows yet another portion of a linear light fixture 1492 that includes the auxiliary optical member 1120 of FIG. 11 fully inserted into the portion of the linear light fixture 1294 of FIG. 12. Referring to FIGS. 1-14, the auxiliary optical member 1120 is coupled to and disposed within the housing 1250 of the portion of the linear light fixture 1492. Specifically, the coupling features 1125 of the auxiliary optical member 1120 are coupled to the coupling features 1295 disposed in the base wall 1265 of the insert 1260 of the housing 1250. Further, the coupling features 1115 of the auxiliary optical member 1120 are coupled to (in this case, adhered to) the inner surface of the right side wall 1254 of the housing 1250. The sides of the body 1121 of the auxiliary optical member 1120 also abut against at least a portion of the inner surface of the top wall 1262 and the bottom wall 1263 of the insert 1260. In this case, the sides of the body 1121 of the auxiliary optical member 1120 do not interact with (e.g., abut against) the coupling features 1240 of the housing 1250.

When the auxiliary optical member 1120 is positioned as shown in FIG. 14, the auxiliary optical member 1120 effectively covers some amount (e.g., 2 inches) of the distal end of the circuit board 1231 (including some of the light sources 1232 disposed on the circuit board 1231) of the lighting assembly 1230. Specifically, the bottom end of the auxiliary optical member 1120 abuts against the circuit board 1231, and the body 1121 of the auxiliary optical member 1120 extends linearly away from the circuit board 1231 until the top end of the auxiliary optical member 1120 abuts the inner surface of the left side wall 1251 toward the top of the right side wall 12541 of the housing 1250. In this case, the body 1121 of the auxiliary optical member 1120 can have a substantially uniform diffusion level along the height 1116 and the width 1117 of the auxiliary optical member 1120.

Figure 15A:
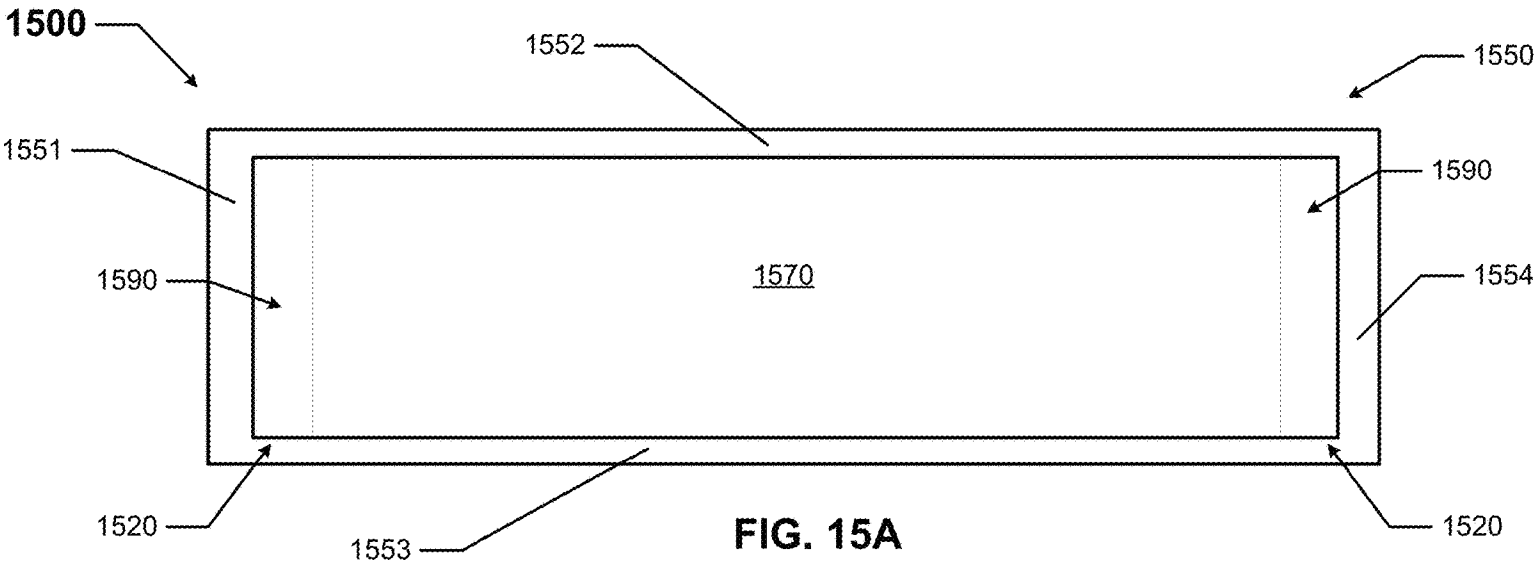
FIGS. 15A and 15B show yet another light fixture with another auxiliary optical member in accordance with certain example embodiments.
Figure 15B:
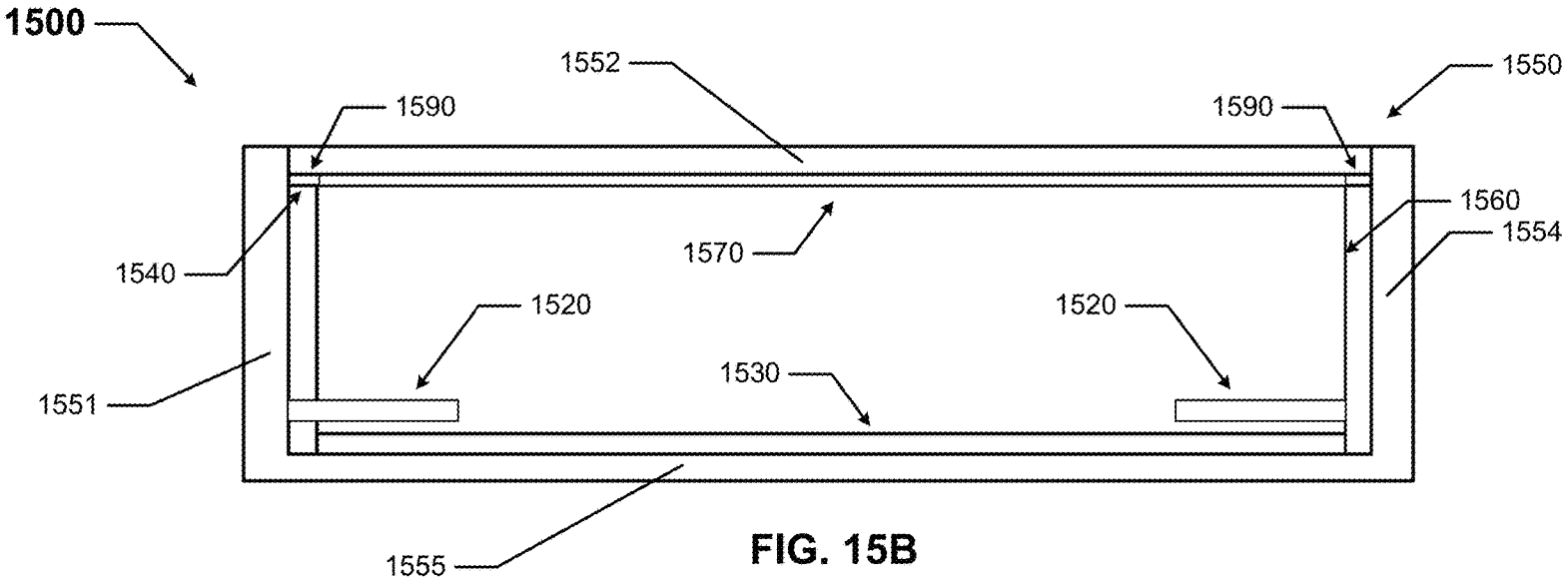

FIGS. 15A and 15B show yet another linear light fixture 1500 with another auxiliary optical member 1520 in accordance with certain example embodiments. Specifically, FIG. 15A shows a top view of the linear light fixture 1500, and FIG. 15B shows a cross-sectional side view of the linear light fixture 1500. Referring to FIGS. 1-15, the linear light fixture 1500 of FIGS. 15A and 15B includes a housing 1550 having a removable insert 1560. The linear light fixture 1500 further includes a lighting assembly 1530 disposed on the insert 1560.

The linear light fixture 1500 of FIGS. 15A and 15B also includes a lens 1570 inserted into the coupling features 1540 of the housing 1550, so that the lens 1570 is perpendicular with the top wall 1552 and the bottom wall 1553 of the housing 1550. Here, the lens 1570 is centered between the left side wall 1551 and the right side wall 1554 of the housing 1550, which means that there is a gap 1590 between the left edge of the lens 1570 and the left side wall 1551, and another gap 1590 between the right edge of the lens 1570 and the right side wall 1554.

The linear light fixture 1500 of FIGS. 15A and 15B also includes two auxiliary optical members 1520. However, these auxiliary optical members 1520 of FIGS. 15A and 15B are different from the auxiliary optical members shown and described above in a few respects. For example, each auxiliary optical member 1520 is positioned in parallel with the lighting assembly 1530 and the bottom wall 1555 of the housing 1550. In this case, each auxiliary optical member 1520 is disposed proximate to, but without actually making physical contact with, the lighting assembly 1530. As another example, each auxiliary optical member 1520 of FIGS. 15A and 15B can have a variable (e.g., gradient) diffusion level, rather than a constant diffusion level, along its height. The diffusion gradient (variation in diffusion level) of each auxiliary optical member 1520 can be specifically designed to project a substantially uniform light that combines substantially seamlessly with the light projected through the lens 1570.

One or more of a number of factors can be used to determine the diffusion gradient of an auxiliary optical member 1520. Such factors can include, but are not limited to, the distance of the auxiliary optical member 1520 to the lighting assembly 1530, the location of the light sources on the lighting assembly 1530, the lumen output of each light source of the lighting assembly 1530, and the material of the auxiliary optical member 1520. In this way, one auxiliary optical member 1520 covers the gap 1590 on the left side, and another auxiliary optical member 1520 covers the gap 1590 on the right side. Further, because of the diffusion characteristics of the body 1521 of the auxiliary optical member 1520, the light emitted by the light sources of the lighting assembly 1530 that traverses an auxiliary optical member 1520 will have substantially the same optical characteristics relative to the light that traverses the lens 1570. In other words, a user looking at light emitted by the linear light fixture 1500 cannot tell a difference between light that traverses an auxiliary optical member 1520 and light that traverses the lens 1570.

Each auxiliary optical member 1520 of FIGS. 15A and 15B can have one or more of any number of coupling features to secure the auxiliary optical member 1520 in position relative to the housing 1550 and/or the lighting assembly 1530. The coupling features of one auxiliary optical member 1520 can be the same as, or different than, the coupling features of the other auxiliary optical member 1520.

Figure 16:
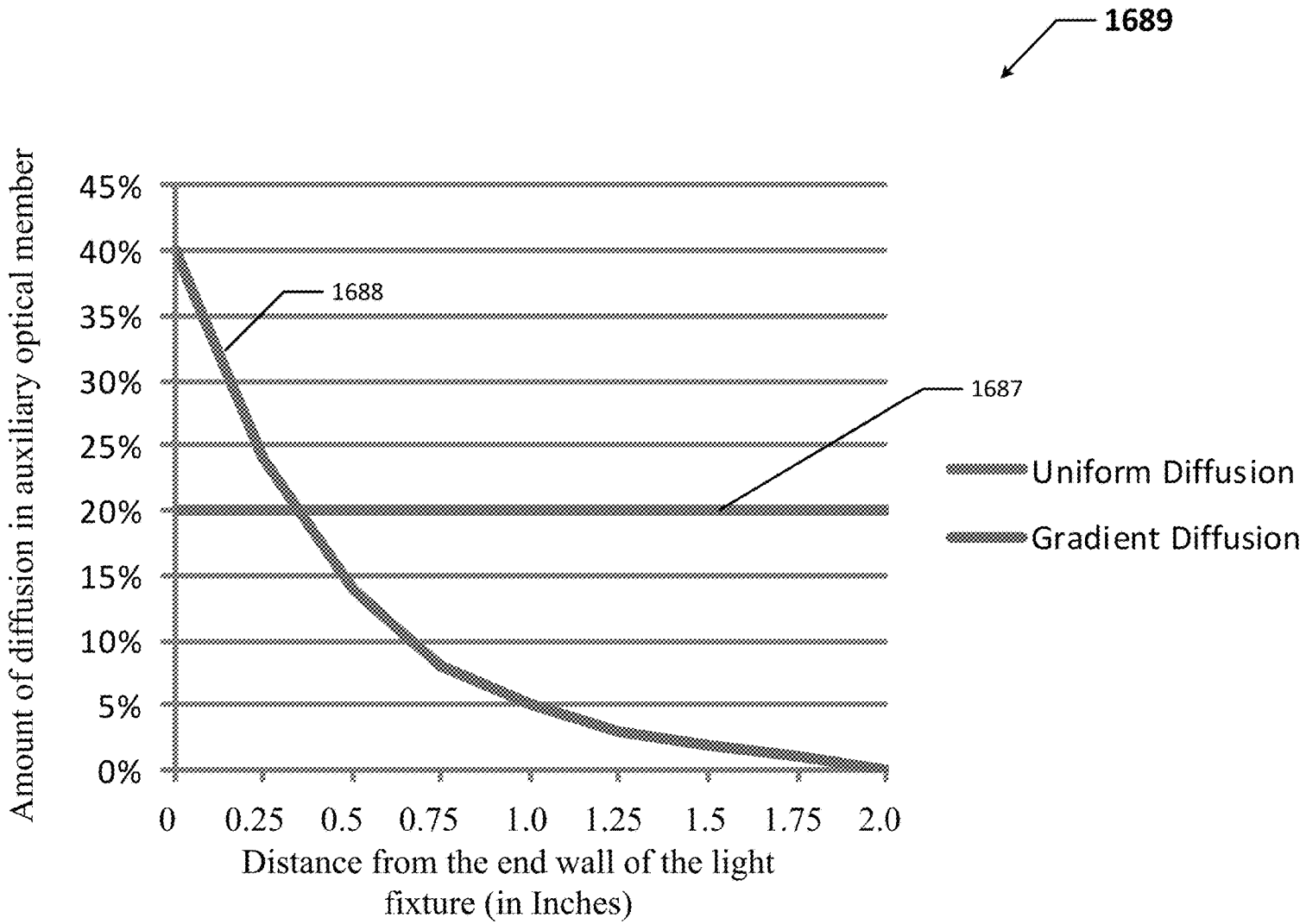
FIG. 16 shows a graph of the diffusion rate for two different auxiliary optical members in accordance with certain example embodiments.

FIG. 16 shows a graph 1689 of the diffusion level for two different auxiliary optical members in accordance with certain example embodiments. Referring to FIGS. 1-16, the graph 1689 of FIG. 16 has a vertical axis showing the amount of diffusion of an auxiliary optical member, and the horizontal axis shows the distance (in inches) from the end wall of the housing of the light fixture. Plot 1687 shows a constant diffusion level of approximately 20% along the height (in this case, 2 inches) of the auxiliary optical member. Plot 1687 represents what could be the diffusion level for auxiliary optical members such as those shown in FIGS. 4A, 4B, 7-9B, and 11. Plot 1688 shows a variable diffusion level, ranging from approximately 40% at one end of the auxiliary optical member, and in a curved (non-linear) fashion decreasing to approximately 0% at the opposite end of the auxiliary optical member. Plot 1688 represents what could be the diffusion level for auxiliary optical members such as that shown in FIGS. 15A and 15B.

Figure 17:
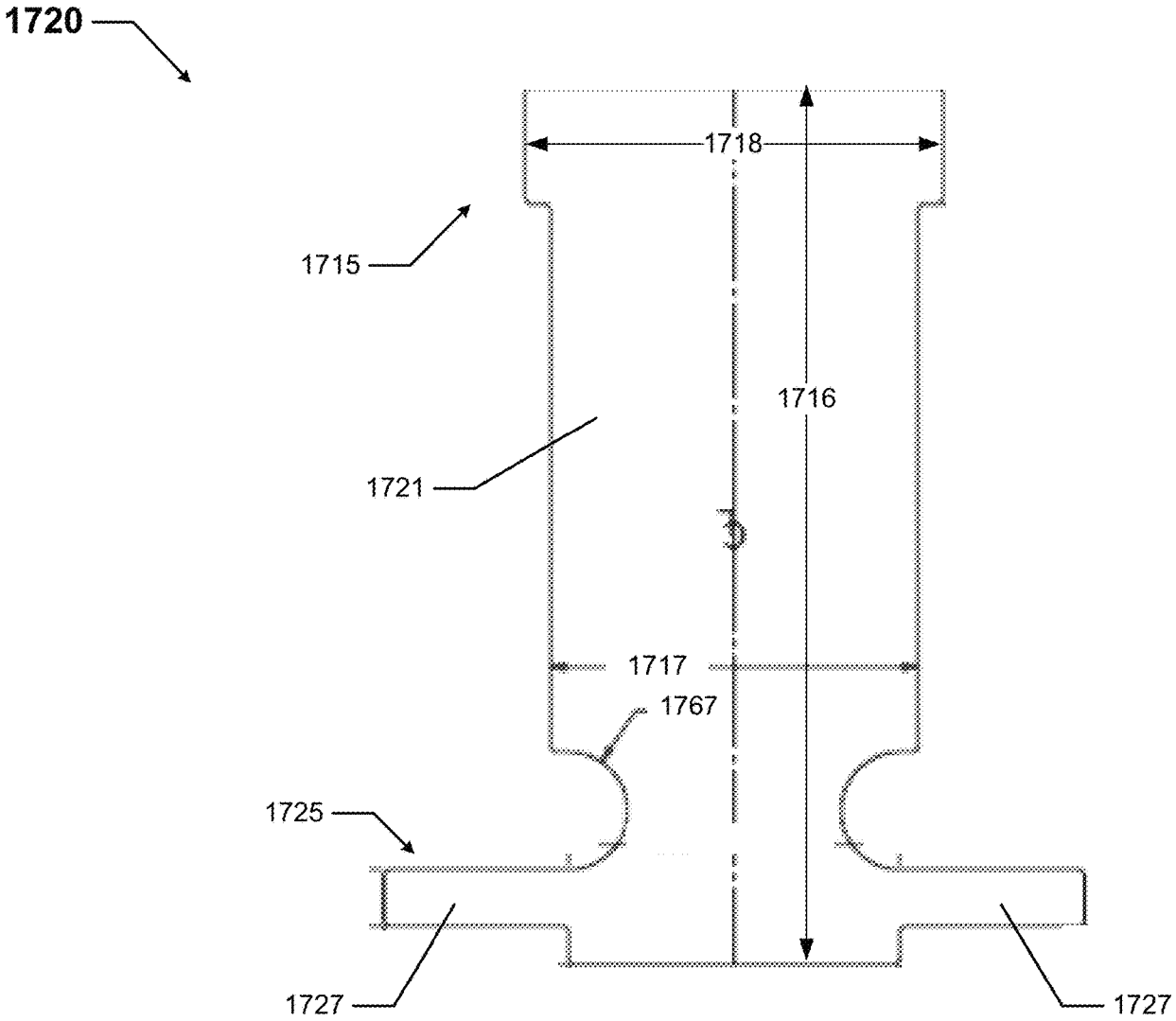
FIGS. 17-20 each shows an auxiliary optical member in accordance with certain example embodiments.
Figure 18:
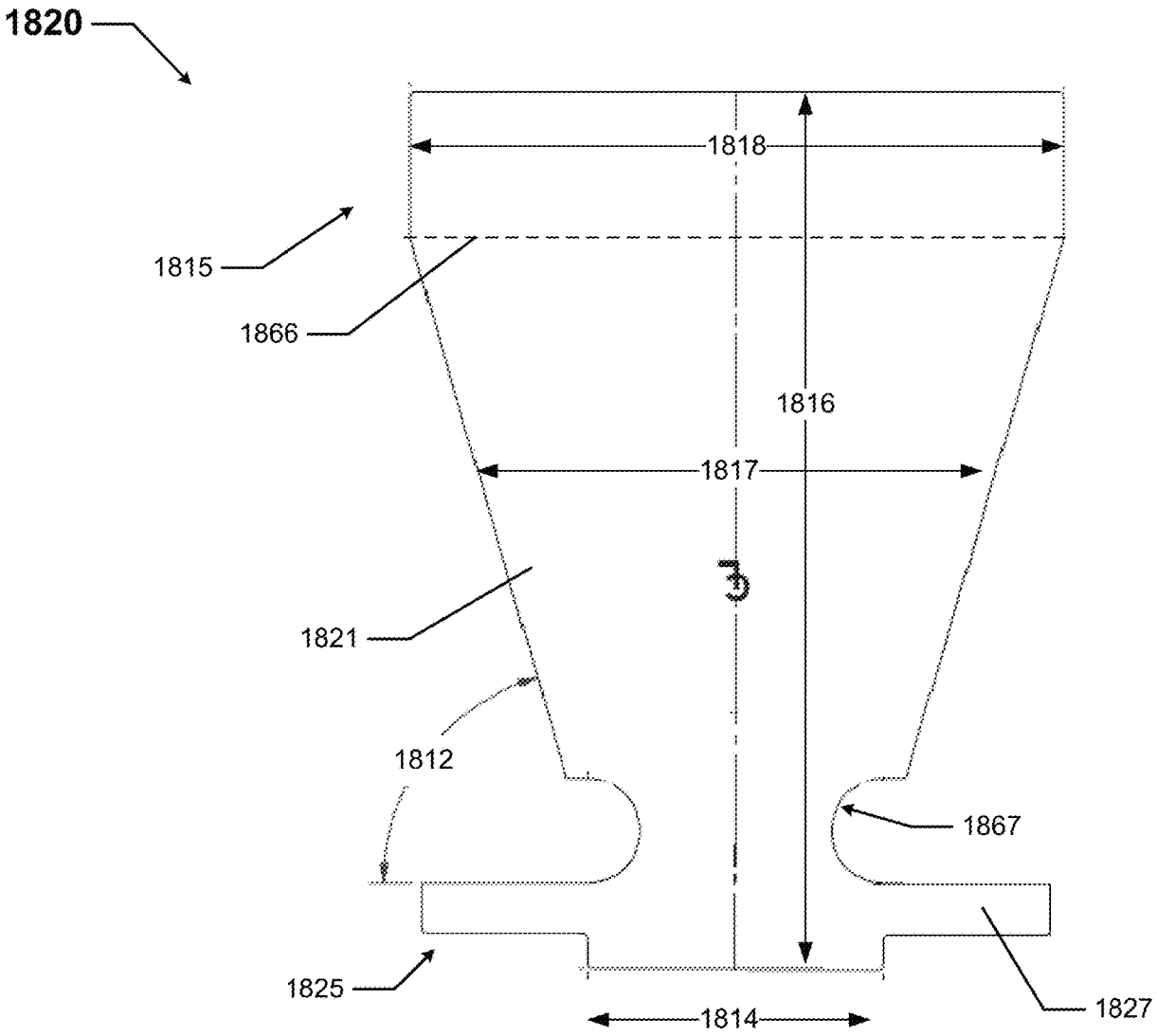
Figure 19:
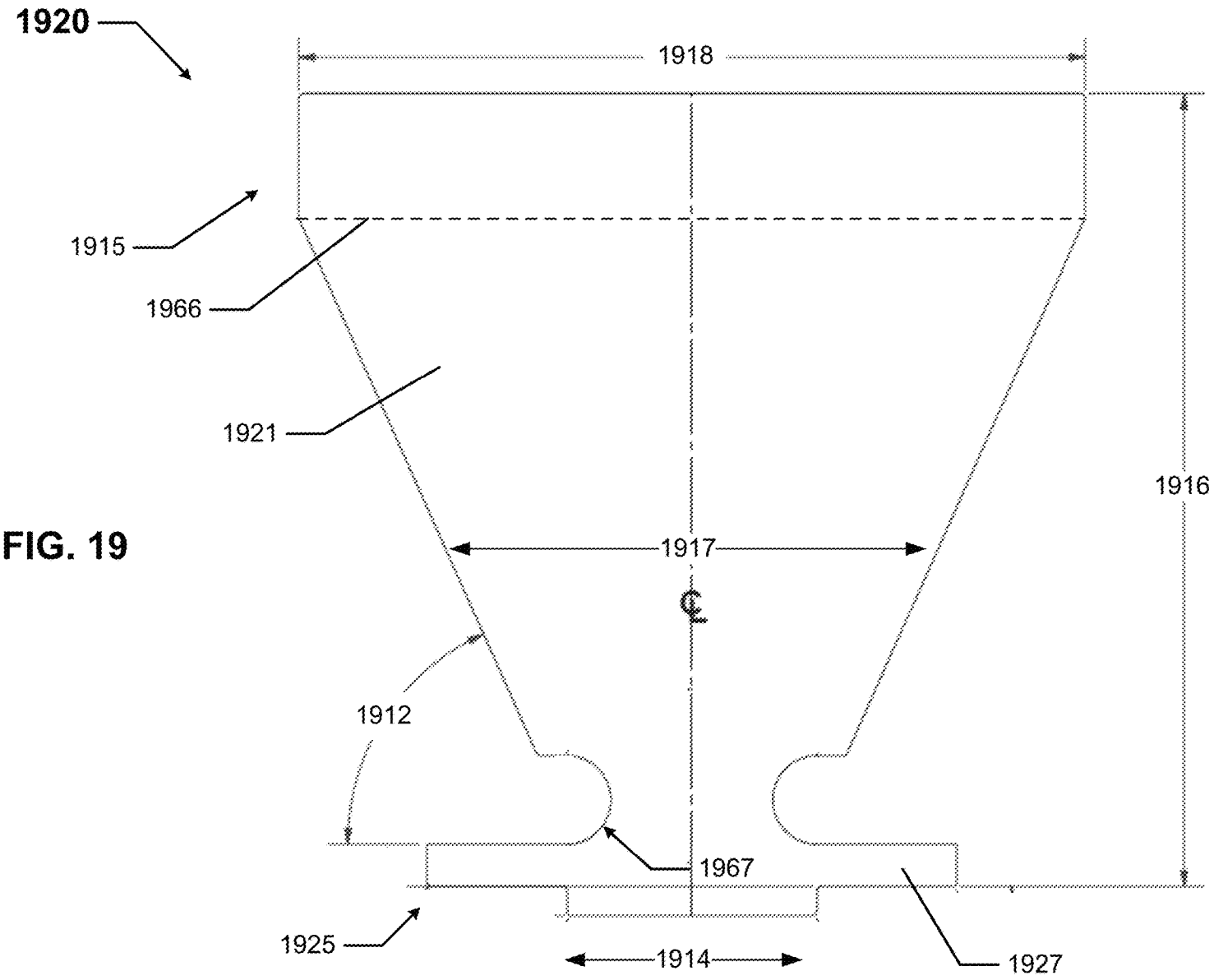
Figure 20:
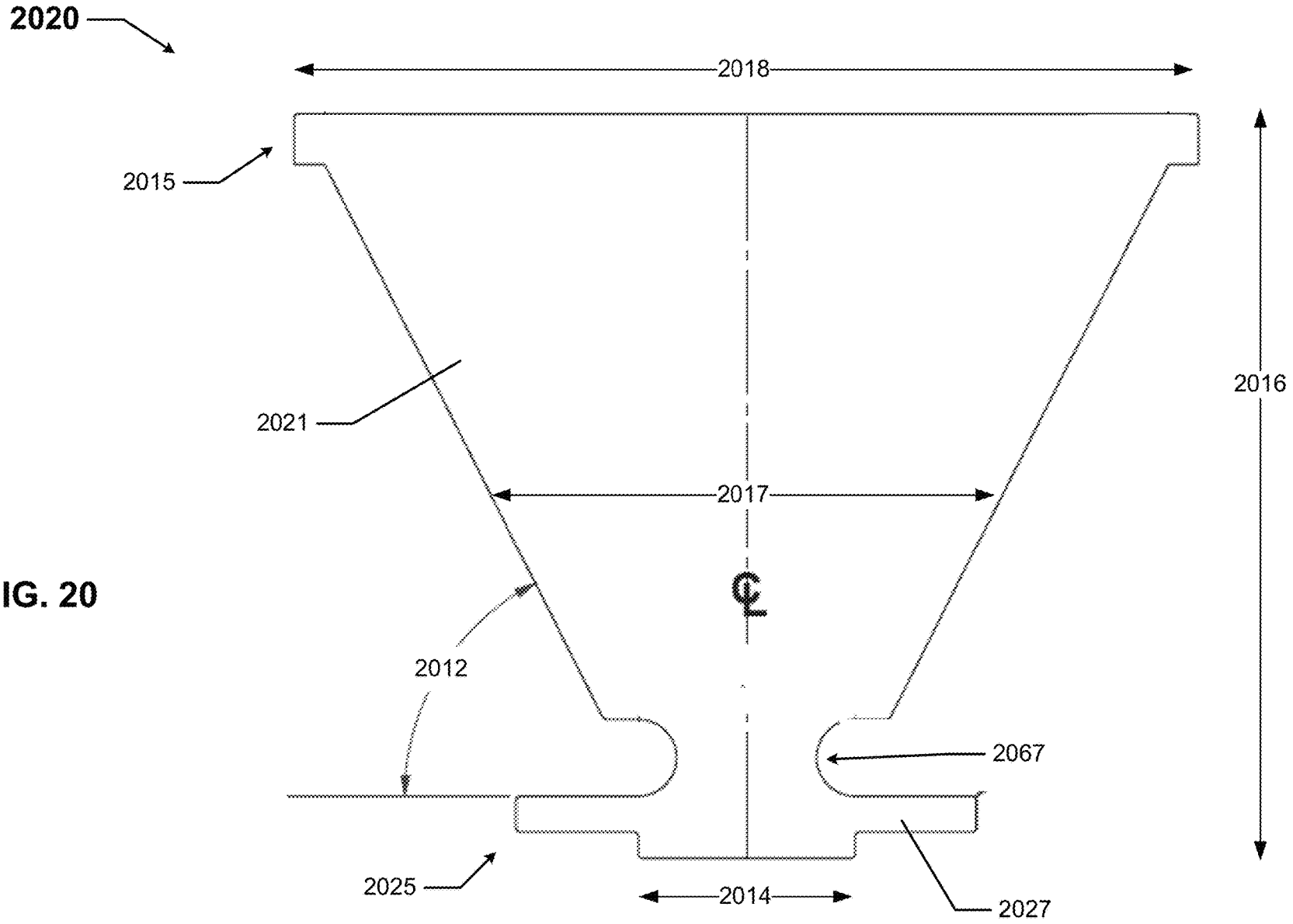

FIGS. 17-20 each shows an auxiliary optical member in accordance with certain example embodiments. Specifically, FIG. 17 shows a front view of auxiliary optical member 1720. FIG. 18 shows a front view of auxiliary optical member 1820. FIG. 19 shows a front view of auxiliary optical member 1920. FIG. 20 shows a front view of auxiliary optical member 2020. Referring to FIGS. 1-20, the auxiliary optical member 1720 of FIG. 17 includes a body 1721 having a thickness (similar to what is shown with the thickness 411 of the auxiliary optical member 420 of FIGS. 4A and 4B) and a height 1716. The thickness of the body 1721 of the auxiliary optical member 1720 can be uniform or variable along the height 1716. If the thickness of the body 1721 of the auxiliary optical member 1720 is variable along the height 1716, then the variability can have any of a number of characteristics (e.g., increasing, decreasing, linear, random).

The body 1721 of the auxiliary optical member 1720 can also have a width 1717. The width 1717 of the body 1721 of the auxiliary optical member 1720 in this case is substantially constant along most of the height 1716 of the body 1721 of the auxiliary optical member 1720. There are two exceptions to the uniform width 1717 of the body 1721. The first exception is just above the two coupling features 1725, where two semi-circular recesses 1767 are disposed in each side of the body 1721. The second exception is at the coupling features 1715, which has a width 1718 that is larger than the width 1717 of the body 1721.

The width 1717 of the body 1721 of the auxiliary optical member 1720 in this case can be configured to complement (e.g., be slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 1720 is positioned relative to an insert of a linear light fixture, there is little to no space between the body 1721 of the auxiliary optical member 1720 and the top wall/bottom wall of the insert along the height 1716 of the body 1721 of the auxiliary optical member 1720.

Similarly, the two semi-circular recesses 1767 that are disposed in each side of the body 1721 can be configured to complement one or more components (e.g., the circuit board, a portion of the insert) of the linear light fixture when the auxiliary optical member 1720 is properly positioned within the linear light fixture. While the recesses 1767 in this case are each semi-circular, a recess 1767 can have any of a number of other shapes, including but not limited to triangular, rectangular, elliptical, and random.

Toward the bottom end of the auxiliary optical member 1720 can be disposed the one or more coupling features 1725, which are used to secure the bottom end of the auxiliary optical member 1720 relative to one or more portions of the housing (e.g., the coupling features 395 of the insert 360). In this case, there are two coupling features 1725, one extending away from each side of the body 1721 of the auxiliary optical member 1720 toward the bottom end of the auxiliary optical member 1720. The two coupling features 1725 in this example are substantially identical to each other. Specifically, each coupling feature 1725 is an extension 1727 that extends laterally away from the body 1721 of the auxiliary optical member 1720.

Each coupling feature 1725 can be flexible (e.g., bendable). In this way, each coupling feature 1725 can be manipulated relative to the body 1721 of the auxiliary optical member 1720 so that the coupling feature 1725 can properly and securely couple to the complementary coupling features (e.g., coupling features 395) of the housing (e.g., housing 350) of the linear light fixture. The extension 1727 of each coupling feature 1725 forms an approximately 90° angle with the outer edge of the body 1721 of the auxiliary optical member 1720.

Toward the top end of the auxiliary optical member 1720 can be disposed one or more coupling features 1715. Such coupling features 1715 can be used to secure the top end of the auxiliary optical member 1720 relative to one or more portions of a housing (e.g., the left side wall 351, the portions of the top wall 352 and the bottom wall 353 disposed above the insert 360). In this case, there are two coupling features 1715, one extending from each side of the body 1721 of the auxiliary optical member 1720 toward the top end of the auxiliary optical member 1720. The two coupling features 1715 in this example are substantially identical to each other. Specifically, each coupling feature 1715 includes an extension in the shape of a flap extending laterally away from the body 1721 of the auxiliary optical member 1720.

As discussed above, since the coupling features 1715 extend away from the body 1721 of the auxiliary optical member 1720, the width 1718 of the coupling features 1715 is larger than the width 1717 of the body 1721 of the auxiliary optical member 1720. In some cases, one or more other coupling features can be part of the auxiliary optical member 1720. For example, adhesive can be disposed on the back side of the body 1721 toward the top end of the auxiliary optical member 1720.

The auxiliary optical member 1820 of FIG. 18 includes a body 1821 having a thickness (similar to what is shown with the thickness 411 of the auxiliary optical member 420 of FIGS. 4A and 4B) and a height 1816. The thickness of the body 1821 of the auxiliary optical member 1820 can be uniform or variable along the height 1816. If the thickness of the body 1821 of the auxiliary optical member 1820 is variable along the height 1816, then the variability can have any of a number of characteristics (e.g., increasing, decreasing, linear, random).

The body 1821 of the auxiliary optical member 1820 can also have a width 1817. The width 1817 of the body 1821 of the auxiliary optical member 1820 in this case is variable along the height 1816 of the body 1821 of the auxiliary optical member 1820. Specifically, the width 1817 of the body 1821 of the auxiliary optical member 1820 is linearly variable (e.g., tapered) along the height 1816 of the body 1821 of the auxiliary optical member 1820, ranging from distance 1814 at the bottom end of the body 1821 to distance 1818 at the top end of the body 1821.

The width 1817 of the body 1821 of the auxiliary optical member 1820 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 1820 is positioned relative to an insert of a linear light fixture, there is little to no space between the body 1821 of the auxiliary optical member 1820 and the top wall/bottom wall of the insert along the height 1816 of the body 1821 of the auxiliary optical member 1820

The width 1817 of the body 1821 of the auxiliary optical member 1820 in this case can be configured to complement (e.g., be slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 1820 is positioned relative to an insert of a linear light fixture, there is little to no space between the body 1821 of the auxiliary optical member 1820 and the top wall/bottom wall of the insert along the height 1816 of the body 1821 of the auxiliary optical member 1820.

In this example, there are two semi-circular recesses 1867 that are disposed in each side of the body 1821, just above the coupling features 1825. These recesses 1867 can be configured to complement one or more components (e.g., the circuit board, a portion of the insert) of the linear light fixture when the auxiliary optical member 1820 is properly positioned within the linear light fixture. While the recesses 1867 in this case are each semi-circular, a recess 1867 can have any of a number of other shapes, including but not limited to triangular, rectangular, elliptical, and random.

Toward the bottom end of the auxiliary optical member 1820 can be disposed the one or more coupling features 1825, which are used to secure the bottom end of the auxiliary optical member 1820 relative to one or more portions of the housing (e.g., the coupling features 395 of the insert 360). In this case, there are two coupling features 1825, one extending away from each side of the body 1821 of the auxiliary optical member 1820 toward the bottom end of the auxiliary optical member 1820. The two coupling features 1825 in this example are substantially identical to each other. Specifically, each coupling feature 1825 is an extension 1827 that extends laterally away from the body 1821 of the auxiliary optical member 1820.

Each coupling feature 1825 can be flexible (e.g., bendable). In this way, each coupling feature 1825 can be manipulated relative to the body 1821 of the auxiliary optical member 1820 so that the coupling feature 1825 can properly and securely couple to the complementary coupling features (e.g., coupling features 395) of the housing (e.g., housing 350) of the linear light fixture. The extension 1827 of each coupling feature 1825 forms an angle 1812 with the outer edge of the body 1821 of the auxiliary optical member 1820.

Toward the top end of the auxiliary optical member 1820 can be disposed one or more coupling features 1815. Such coupling features 1815 can be used to secure the top end of the auxiliary optical member 1820 relative to one or more portions of a housing (e.g., the left side wall 351, the portions of the top wall 352 and the bottom wall 353 disposed above the insert 360). For example, the coupling feature 1815 can include an adhesive disposed along the back surface of the body 1821 of the auxiliary optical member 1820 toward the top end of the auxiliary optical member 1820. The coupling feature 1815 in this example includes a perforation 1866 that allows the coupling feature 1815 to be bent along a certain line along the perforation 1866. In order for the coupling feature 1815 to adhere to or abut against a side wall of the housing, the top end of the body 1821 of the auxiliary optical member 1820 can be flexible (e.g., bendable).

The auxiliary optical member 1920 of FIG. 19 includes a body 1921 having a thickness (similar to what is shown with the thickness 411 of the auxiliary optical member 420 of FIGS. 4A and 4B) and a height 1916. The thickness of the body 1921 of the auxiliary optical member 1920 can be uniform or variable along the height 1916. If the thickness of the body 1921 of the auxiliary optical member 1920 is variable along the height 1916, then the variability can have any of a number of characteristics (e.g., increasing, decreasing, linear, random).

The body 1921 of the auxiliary optical member 1920 can also have a width 1917. The width 1917 of the body 1921 of the auxiliary optical member 1920 in this case is variable along the height 1916 of the body 1921 of the auxiliary optical member 1920. Specifically, the width 1917 of the body 1921 of the auxiliary optical member 1920 is linearly variable (e.g., tapered) along the height 1916 of the body 1921 of the auxiliary optical member 1920, ranging from distance 1914 at the bottom end of the body 1921 to distance 1918 at the top end of the body 1921.

The width 1917 of the body 1921 of the auxiliary optical member 1920 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 1920 is positioned relative to an insert of a linear light fixture, there is little to no space between the body 1921 of the auxiliary optical member 1920 and the top wall/bottom wall of the insert along the height 1916 of the body 1921 of the auxiliary optical member 1920

The width 1917 of the body 1921 of the auxiliary optical member 1920 in this case can be configured to complement (e.g., be slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 1920 is positioned relative to an insert of a linear light fixture, there is little to no space between the body 1921 of the auxiliary optical member 1920 and the top wall/bottom wall of the insert along the height 1916 of the body 1921 of the auxiliary optical member 1920.

In this example, there are two semi-circular recesses 1967 that are disposed in each side of the body 1921, just above the coupling features 1925. These recesses 1967 can be configured to complement one or more components (e.g., the circuit board, a portion of the insert) of the linear light fixture when the auxiliary optical member 1920 is properly positioned within the linear light fixture. While the recesses 1967 in this case are each semi-circular, a recess 1967 can have any of a number of other shapes, including but not limited to triangular, rectangular, elliptical, and random.

Toward the bottom end of the auxiliary optical member 1920 can be disposed the one or more coupling features 1925, which are used to secure the bottom end of the auxiliary optical member 1920 relative to one or more portions of the housing (e.g., the coupling features 395 of the insert 360). In this case, there are two coupling features 1925, one extending away from each side of the body 1921 of the auxiliary optical member 1920 toward the bottom end of the auxiliary optical member 1920. The two coupling features 1925 in this example are substantially identical to each other. Specifically, each coupling feature 1925 is an extension 1927 that extends laterally away from the body 1921 of the auxiliary optical member 1920.

Each coupling feature 1925 can be flexible (e.g., bendable). In this way, each coupling feature 1925 can be manipulated relative to the body 1921 of the auxiliary optical member 1920 so that the coupling feature 1925 can properly and securely couple to the complementary coupling features (e.g., coupling features 395) of the housing (e.g., housing 350) of the linear light fixture. The extension 1927 of each coupling feature 1925 forms an angle 1912 with the outer edge of the body 1921 of the auxiliary optical member 1920. The width 1917 of the body 1921 becomes greater than the width of the body 1821 of the auxiliary optical member 1820 of FIG. 18, which also means that the angle 1912 is less than the corresponding angle 1812 of FIG. 18.

Toward the top end of the auxiliary optical member 1920 can be disposed one or more coupling features 1915. Such coupling features 1915 can be used to secure the top end of the auxiliary optical member 1920 relative to one or more portions of a housing (e.g., the left side wall 351, the portions of the top wall 352 and the bottom wall 353 disposed above the insert 360). For example, the coupling feature 1915 can include an adhesive disposed along the back surface of the body 1921 of the auxiliary optical member 1920 toward the top end of the auxiliary optical member 1920. The coupling feature 1915 in this example includes a perforation 1966 that allows the coupling feature 1915 to be bent along a certain line along the perforation 1966. In order for the coupling feature 1915 to adhere to or abut against a side wall of the housing, the top end of the body 1921 of the auxiliary optical member 1920 can be flexible (e.g., bendable).

The auxiliary optical member 2020 of FIG. 20 includes a body 2021 having a thickness (similar to what is shown with the thickness 411 of the auxiliary optical member 420 of FIGS. 4A and 4B) and a height 2016. The thickness of the body 2021 of the auxiliary optical member 2020 can be uniform or variable along the height 2016. If the thickness of the body 2021 of the auxiliary optical member 2020 is variable along the height 2016, then the variability can have any of a number of characteristics (e.g., increasing, decreasing, linear, random).

The body 2021 of the auxiliary optical member 2020 can also have a width 2017. The width 2017 of the body 2021 of the auxiliary optical member 2020 in this case is variable along the height 2016 of the body 2021 of the auxiliary optical member 2020. Specifically, the width 2017 of the body 2021 of the auxiliary optical member 2020 is linearly variable (e.g., tapered) along the height 2016 of the body 2021 of the auxiliary optical member 2020, ranging from distance 2014 at the bottom end of the body 2021 to distance 2018 at the top end of the body 2021.

The width 2017 of the body 2021 of the auxiliary optical member 2020 in this case is tapered in such a way as to be substantially the same as (or slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 2020 is positioned relative to an insert of a linear light fixture, there is little to no space between the body 2021 of the auxiliary optical member 2020 and the top wall/bottom wall of the insert along the height 2016 of the body 2021 of the auxiliary optical member 2020

The width 2017 of the body 2021 of the auxiliary optical member 2020 in this case can be configured to complement (e.g., be slightly less than) the distance (e.g., distance 359) between the top wall (e.g., top wall 362) and the bottom wall (e.g., bottom wall 363) of an insert (e.g., insert 360) along the height of those walls. In other words, when the auxiliary optical member 2020 is positioned relative to an insert of a linear light fixture, there is little to no space between the body 2021 of the auxiliary optical member 2020 and the top wall/bottom wall of the insert along the height 2016 of the body 2021 of the auxiliary optical member 2020.

In this example, there are two semi-circular recesses 2067 that are disposed in each side of the body 2021, just above the coupling features 2025. These recesses 2067 can be configured to complement one or more components (e.g., the circuit board, a portion of the insert) of the linear light fixture when the auxiliary optical member 2020 is properly positioned within the linear light fixture. While the recesses 2067 in this case are each semi-circular, a recess 2067 can have any of a number of other shapes, including but not limited to triangular, rectangular, elliptical, and random.

Toward the bottom end of the auxiliary optical member 2020 can be disposed the one or more coupling features 2025, which are used to secure the bottom end of the auxiliary optical member 2020 relative to one or more portions of the housing (e.g., the coupling features 395 of the insert 360). In this case, there are two coupling features 2025, one extending away from each side of the body 2021 of the auxiliary optical member 2020 toward the bottom end of the auxiliary optical member 2020. The two coupling features 2025 in this example are substantially identical to each other. Specifically, each coupling feature 2025 is an extension 2027 that extends laterally away from the body 2021 of the auxiliary optical member 2020.

Each coupling feature 2025 can be flexible (e.g., bendable). In this way, each coupling feature 2025 can be manipulated relative to the body 2021 of the auxiliary optical member 2020 so that the coupling feature 2025 can properly and securely couple to the complementary coupling features (e.g., coupling features 395) of the housing (e.g., housing 350) of the linear light fixture. The extension 2027 of each coupling feature 2025 forms an angle 2012 with the outer edge of the body 2021 of the auxiliary optical member 2020. The width 2017 of the body 2021 becomes greater than the width of the bodies of the auxiliary optical members of FIGS. 18 and 19, which also means that the angle 2012 is less than the corresponding angle 1812 of FIG. 18 and the corresponding angle 1912 of FIG. 19.

Toward the top end of the auxiliary optical member 2020 can be disposed one or more coupling features 2015. Such coupling features 2015 can be used to secure the top end of the auxiliary optical member 2020 relative to one or more portions of a housing (e.g., the left side wall 351, the portions of the top wall 352 and the bottom wall 353 disposed above the insert 360). In this case, there are two coupling features 2015, one extending from each side of the body 2021 of the auxiliary optical member 2020 toward the top end of the auxiliary optical member 2020. The two coupling features 2015 in this example are substantially identical to each other. Specifically, each coupling feature 2015 includes an extension in the shape of a flap extending laterally away from the body 2021 of the auxiliary optical member 2020.

As discussed above, since the coupling features 2015 extend away from the body 2021 of the auxiliary optical member 2020, the width 2018 of the coupling features 2015 is larger than the width 2017 of the body 2021 of the auxiliary optical member 2020. In some cases, one or more other coupling features can be part of the auxiliary optical member 2020. For example, adhesive can be disposed on the back side of the body 2021 toward the top end of the auxiliary optical member 2020.

As discussed above, example auxiliary optical members described herein can be made of one or more of any of a number of materials. In some cases, the one or more materials that make up an example auxiliary optical member can be manipulated (e.g., reshaped) by a user. For example, height of the top one or more coupling features (e.g., coupling feature 2015) of an example auxiliary optical members can be cut shorter (e.g., with scissors, with a cutting knife) by a user so that the coupling feature does not extend beyond the corresponding side wall (e.g., left side wall 351) of the housing of a linear light fixture. Similarly, other portions (e.g., one or both sides of the body) of an example auxiliary optical member can be manipulated by a user.

Example embodiments can allow for light fixtures that emit a more uniform and aesthetically pleasing light. Example auxiliary optical members can be removed and replaced to create the desired optical effect. Example embodiments can also allow for completely concealing components within a linear light fixture that would otherwise be visible with only the lens in place. Example embodiments can be specifically designed to fit within any of a number of spaces within any of a number of different linear light fixtures.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A linear light fixture, comprising:

a housing comprising at least one wall that forms a cavity, wherein the at least one wall comprises a top wall, a bottom wall opposite the top wall, a first side wall disposed between the top wall and the bottom wall, and a second side wall disposed between the top wall and the bottom wall and opposite the first side wall, wherein the top wall and the bottom wall comprise a receiving feature disposed at their distal end;

a lighting assembly comprising a circuit board and a plurality of light sources disposed on the circuit board, wherein the plurality of light sources are arranged in a linear fashion with respect to each other on the circuit board, wherein the lighting assembly is disposed within the cavity of the housing toward a proximal end of the top wall, the bottom wall, the first side wall, and the second side wall;

a lens slidably disposed within the receiving feature of the housing; and a first auxiliary optical member disposed within the cavity of the housing, wherein the first auxiliary optical member comprises a first body having a first end and a second end, wherein the first body comprises a light diffusion film, wherein the first body further comprises a planar main portion disposed between the first end and the second end, wherein the first auxiliary optical member fills a first gap between the lens and the first side wall of the housing, and wherein a first portion of light emitted by the plurality of light sources passes through the light diffusion film of the first body of the first auxiliary optical member, wherein the first end of the first auxiliary optical member is disposed proximate to a top surface of the circuit board toward the first side wall of the housing, wherein the second end of the first auxiliary optical member is disposed proximate to a bottom surface of the lens at a distal end of the first side wall of the housing, wherein the planar main portion of the first body of the first auxiliary optical member forms a non-perpendicular angle with the circuit board and is antiparallel with the first side wall of the housing.

2. The linear light fixture of claim 1, wherein the light diffusion film of the first auxiliary optical member is of a substantially uniform thickness between the first end and the second end.

3. The linear light fixture of claim 1, wherein the first auxiliary optical member further comprises at least one coupling feature disposed toward the first end, wherein the at least one coupling feature couples to at least one complementary coupling feature of the housing.

4. The linear light fixture of claim 3, wherein the at least one coupling feature comprises a tab, and wherein the at least one complementary coupling feature comprises a slot.

5. The linear light fixture of claim 3, wherein the at least one complementary coupling feature is disposed in a removable insert of the housing, wherein the lighting assembly is disposed on the removable insert, wherein the at least one complementary coupling feature is disposed adjacent to the circuit board of the lighting assembly.

6. The linear light fixture of claim 1, wherein the first auxiliary optical member further comprises a pair of lateral extensions disposed toward the second end, wherein the pair of lateral extensions abut against the top wall and the bottom wall of the housing.

7. The linear light fixture of claim 1, wherein the light diffusion film of the first auxiliary optical member has a gradient diffusion level between the first end and the second end.

8. The linear light fixture of claim 7, wherein the first auxiliary optical member is disposed substantially in parallel with the circuit board.

9. The linear light fixture of claim 7, wherein the light diffusion film has a first diffusion level at its first end and a second diffusion level at its second end, wherein the second diffusion level is greater than the first diffusion level.

10. The linear light fixture of claim 1, further comprising:

a second auxiliary optical member disposed within the cavity of the housing, wherein the second auxiliary optical member comprises a second body having a first end and a second end, wherein the second body comprises the light diffusion film, wherein the second auxiliary optical member fills a second gap between the lens and the second side wall of the housing, wherein a second portion of light emitted by the plurality of light sources passes through the light diffusion film of the second body of the second auxiliary optical member.

11. The linear light fixture of claim 3, wherein the at least one coupling feature comprises adhesive, wherein the adhesive is configured to adhere the second end of the first body to the at least one wall of the housing.

12. The linear light fixture of claim 5, wherein the removable insert is U-shaped.

13. The linear light fixture of claim 3, wherein the at least one coupling feature comprises a pair of flexible lateral extensions extending from the first end, wherein the pair of flexible lateral extensions is configured to be inserted into a pair of slots disposed in a base of a removable insert of the housing.

14. The linear light fixture of claim 1, wherein the first body of the first auxiliary optical member has a substantially uniform diffusion between the first end and the second end of the first body.

15. The linear light fixture of claim 1, wherein the light diffusion film of the first body has a gradient diffusion between the first end and the second end, wherein the first body is disposed substantially parallel with the circuit board of the lighting assembly.

16. A linear light fixture, comprising:

a housing comprising a U-shaped insert and at least one wall that forms a cavity, wherein the at least one wall comprises a top wall, a bottom wall opposite the top wall, a first side wall disposed between the top wall and the bottom wall, and a second side wall disposed between the top wall and the bottom wall and opposite the first side wall, wherein the U-shaped insert is disposed within the cavity adjacent to a proximal end of the top wall, the bottom wall, the first side wall, and the second side wall, wherein the U-shaped insert has disposed therein at least one slot;

a lighting assembly disposed on a base of the U-shaped insert, wherein the lighting assembly comprises a circuit board and a plurality of light sources disposed on the circuit board; and an auxiliary optical member disposed within the cavity of the housing, wherein the auxiliary optical member comprises a body having a first end, a second end, and a planar main portion disposed between the first end and the second end, wherein the body comprises a light diffusion film, wherein the auxiliary optical member further comprises at least one coupling feature that extends from the first end and couples to the at least one slot of the U-shaped insert, wherein the auxiliary optical member fills a gap between the lens and the first side wall of the housing, and wherein a first portion of light emitted by the plurality of light sources passes through the light diffusion film of the first body of the auxiliary optical member.

* * * * *